US011854407B2

(12) United States Patent
Herriot

(10) Patent No.: US 11,854,407 B2
(45) Date of Patent: Dec. 26, 2023

(54) SYSTEM AND METHOD FOR AIRSPACE PLANNING

(71) Applicant: James W. Herriot, Palo Alto, CA (US)

(72) Inventor: James W. Herriot, Palo Alto, CA (US)

( * ) Notice: Subject to any disclaimer, the term of this patent is extended or adjusted under 35 U.S.C. 154(b) by 65 days.

(21) Appl. No.: 17/963,771

(22) Filed: Oct. 11, 2022

(65) Prior Publication Data

US 2023/0112803 A1 Apr. 13, 2023

Related U.S. Application Data

(60) Provisional application No. 63/254,926, filed on Oct. 12, 2021.

(51) Int. Cl.
*G08G 5/00* (2006.01)

(52) U.S. Cl.
CPC ..... *G08G 5/0017* (2013.01); *G08G 5/003* (2013.01)

(58) Field of Classification Search
CPC ..... G08G 5/0017; G08G 5/003
See application file for complete search history.

(56) References Cited

U.S. PATENT DOCUMENTS

| | | | | |
|---|---|---|---|---|
| 6,266,610 | B1 * | 7/2001 | Schultz | G06Q 10/047 701/533 |
| 2008/0059058 | A1 * | 3/2008 | Caillaud | G05D 1/0202 701/467 |
| 2009/0125221 | A1 * | 5/2009 | Estkowski | G08G 5/045 701/120 |
| 2013/0304300 | A1 * | 11/2013 | Peake | G05D 1/0217 701/41 |
| 2016/0299506 | A1 * | 10/2016 | Bruggeman | G05D 1/106 |
| 2016/0358480 | A1 * | 12/2016 | Kang | G08G 5/0026 |
| 2020/0401650 | A1 * | 12/2020 | Chen | G06N 5/02 |
| 2021/0034928 | A1 * | 2/2021 | Oh | G06N 5/01 |

* cited by examiner

*Primary Examiner* — Hunter B Lonsberry
(74) *Attorney, Agent, or Firm* — Paradice & Li LLP

(57) ABSTRACT

A method for dynamic airspace planning is performed by one or more processors, and includes identifying, in an airspace model that includes an array of nodes, a set of path elements. Each path element connects a pair of adjacent nodes in the array. The method includes obtaining, for each aircraft in a set of aircraft, a respective current position on a path element. The set of aircraft may include thousands of manned and/or unmanned aircraft. The method includes obtaining, for each aircraft, a respective final position on a path element; and enumerating, for each aircraft, a respective set of flight paths. Each flight path includes one or more path elements, and extends from at least the current position of a respective aircraft to the final position of the respective aircraft. The method includes determining, for each aircraft, a respective optimal flight path based on the respective set of flight paths.

33 Claims, 22 Drawing Sheets

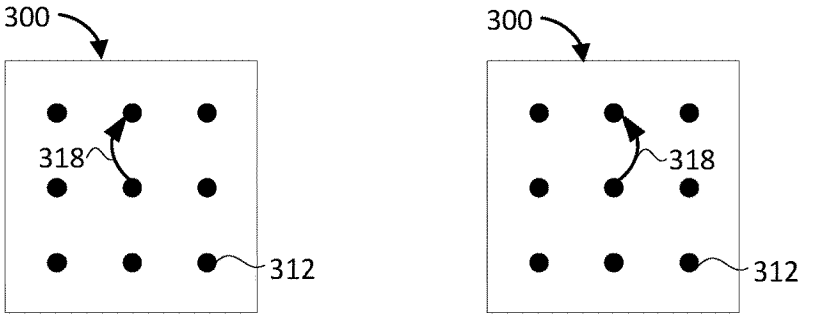
FIG. 3I
FIG. 3J
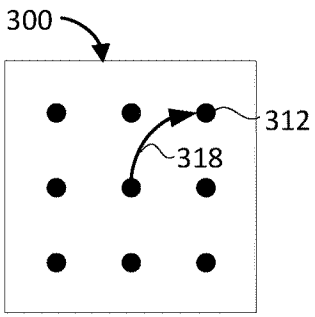
FIG. 3K
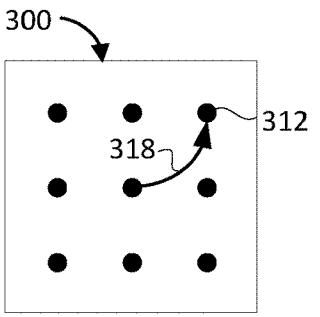
FIG. 3L
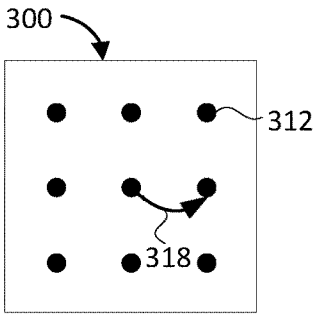
FIG. 3M
FIG. 3N
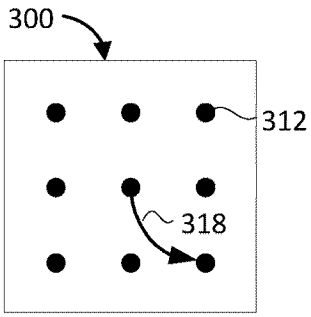
FIG. 3O
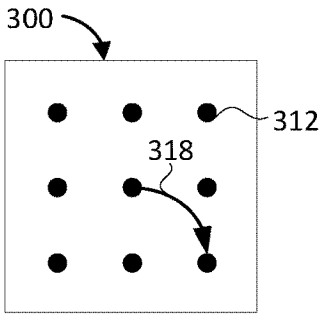
FIG. 3P

| **Example Attributes 826 Associated with Path Element 818** |
| --- |
| Path element identifier |
| Position(s) |
| Distance(s) |
| Time(s) |
| Time period(s) |
| Amount(s) of fuel |
| Cost(s) |
| Wind vector(s) |
| Airspeed(s) |
| Aircraft identifier |

| **Example Parameters 928 Associated with Flight Path 924** |
|---|
| Flight path identifier |
| Position(s) |
| Distance(s) |
| Time(s) |
| Time period(s) |
| Amount(s) of fuel |
| Cost(s) |
| Weather condition(s) |
| Noise level(s) |
| Runway direction |

SYSTEM AND METHOD FOR AIRSPACE PLANNING

CROSS-REFERENCE TO RELATED APPLICATION

This application claims priority and benefit under 35 U.S.C. § 119(e) to U.S. Provisional Patent Application No. 63/254,926, filed on Oct. 12, 2021, which is incorporated herein by reference.

TECHNICAL FIELD

The present embodiments relate generally to systems and methods for airspace planning, and specifically to dynamically generating and selecting optimized flight paths for one or more aircraft (e.g., some or all manned and/or unmanned aircraft) in an airspace.

BACKGROUND OF RELATED ART

The flight path of an aircraft is largely determined by manual processes. For example, a pilot may be required to direct an aircraft along a flight path specified in a pre-filed flight plan, aviation map, and/or voice instructions provided by air traffic control (ATC). However, flight paths specified by ATC voice instructions may not be optimized to meet certain criteria, such as minimizing fuel consumption or flight time. Further, flight paths provided in pre-filed flight plans or aviation maps are static, and thus cannot account for changes in flight conditions.

SUMMARY

This Summary is provided to introduce in a simplified form a selection of concepts that are further described below in the Detailed Description. This Summary is not intended to identify key features or essential features of the claimed subject matter, nor is it intended to limit the scope of the claimed subject matter.

A method for airspace planning is disclosed. The method may be performed by one or more processors, and include obtaining a first position of a first aircraft and a final position of the first aircraft in an airspace model. The airspace model may include an array of nodes, and each of the first position and the final position may coincide with, or be proximate to, a respective node in the array. Further, each node in the array may be equidistant to other nodes in the array. The method may further include generating a plurality of first flight paths for the first aircraft. Each of the plurality of first flight paths may connect two or more adjacent nodes in the array and extend from at least the first position to the final position. The method may further include obtaining one or more parameters associated with each of the plurality of first flight paths, and selecting an optimal first flight path among the plurality of first flight paths. The selection may be based on the one or more parameters associated with each of the plurality of first flight paths.

A system for airspace planning is disclosed. The system may include at least one processor and at least one memory storing instructions that, when executed by the at least one processor, cause the system to obtain first and final positions of a first aircraft in an airspace model. The airspace model may include an array of nodes, and each of the first and final positions may coincide with, or be proximate to, a respective node in the array. The instructions, when executed by the at least one processor, may further cause the system to generate a plurality of first flight paths for the first aircraft. Each of the plurality of first flight paths may connect two or more adjacent nodes in the array and extend from at least the first position to the final position. The instructions, when executed by the at least one processor, may further cause the system to obtain one or more parameters associated with each of the plurality of first flight paths, and select an optimal first flight path among the plurality of first flight paths based on the one or more parameters associated with each of the plurality of first flight paths.

A system for airspace planning is disclosed. The system may include at least one processor and at least one memory storing instructions that, when executed by the at least one processor, cause the system to generate, in an airspace model that includes an array of nodes, a plurality of pathways. Each of the plurality of pathways may comprise one or more path elements, and each of the one or more path elements may connect a pair of adjacent nodes in the array. The instructions, when executed by the at least one processor, may further cause the system to obtain first and final positions of a first aircraft in an airspace model. Each of the first and final positions may coincide with, or be proximate to, a respective node in the array. The instructions, when executed by the at least one processor, may further cause the system to generate a plurality of first flight paths for the first aircraft based on the plurality of pathways. Each of the plurality of first flight paths may extend from at least the first position to the final position. The instructions, when executed by the at least one processor, may further cause the system to obtain one or more parameters associated with each of the plurality of first flight paths, and select an optimal first flight path among the plurality of first flight paths based on the one or more parameters associated with each of the plurality of first flight paths.

A method for airspace planning is disclosed. The method may be performed by one or more processors and include identifying, in an airspace model that includes an array of nodes, a set of path elements. Each path element in the set of path elements may connect a pair of adjacent nodes in the array. The method may further include obtaining, for each aircraft in a set of aircraft represented in the airspace model, a respective current position on a path element in the set of path elements. The method may also include obtaining, for each aircraft in the set of aircraft, a respective final position on a path element in the set of path elements. Further, the method may include enumerating, for each aircraft in the set of aircraft, a respective set of flight paths, wherein each flight path in each of the respective sets of flight paths includes one or more path elements in the set of path elements, and extends from at least the current position of a respective aircraft in the set of aircraft to the final position of the respective aircraft. The method may also include determining, for each aircraft in the set of aircraft, a respective optimal flight path based on the respective set of flight paths.

BRIEF DESCRIPTION OF THE DRAWINGS

The present embodiments are illustrated by way of example and are not intended to be limited by the figures of the accompanying drawings.

DETAILED DESCRIPTION

Figure 1:
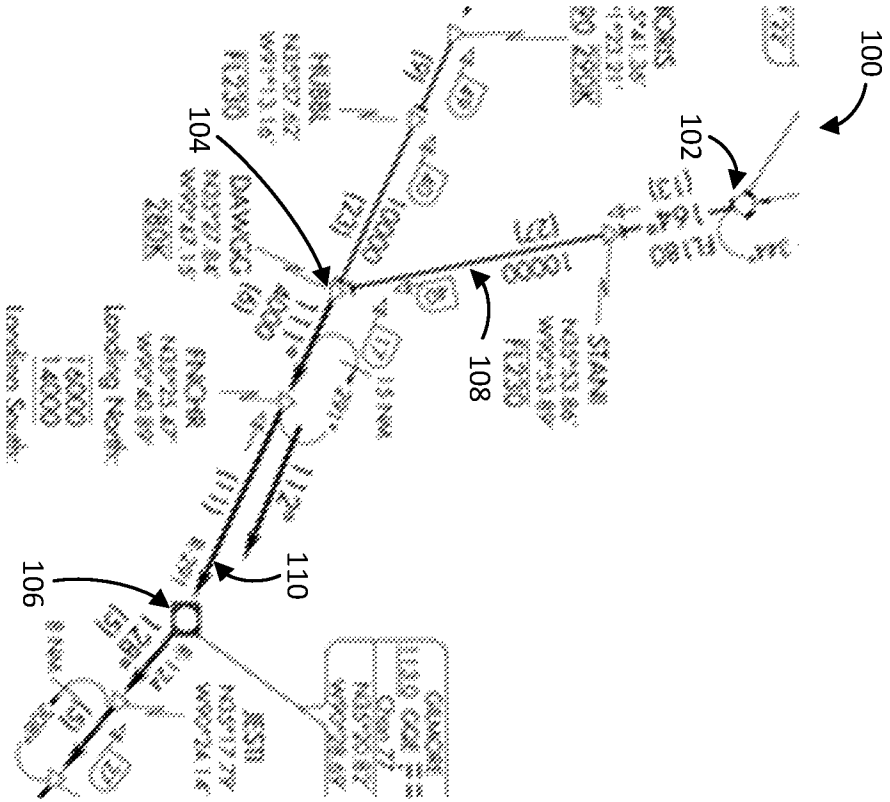
FIG. 1 shows an example aviation map.

In the following description, numerous specific details are set forth such as examples of specific components, circuits, and processes to provide a thorough understanding of the present disclosure. The term "coupled" as used herein means connected directly to or connected through one or more intervening components or circuits. Also, in the following description and for purposes of explanation, specific nomenclature is set forth to provide a thorough understanding of the aspects of the disclosure. However, it will be apparent to one skilled in the art that these specific details may not be required to practice the example embodiments. In other instances, well-known circuits and devices are shown in block diagram form to avoid obscuring the present disclosure. Some portions of the detailed descriptions which follow are presented in terms of procedures, logic blocks, processing and other symbolic representations of operations on data bits within a computer memory. The interconnection between circuit elements or software blocks may be shown as buses or as single signal lines. Each of the buses may alternatively be a single signal line, and each of the single signal lines may alternatively be buses, and a single line or bus may represent any one or more of a myriad of physical or logical mechanisms for communication between components.

Unless specifically stated otherwise as apparent from the following discussions, it is appreciated that throughout the present application, discussions utilizing the terms such as "accessing," "receiving," "sending," "using," "selecting," "determining," "normalizing," "multiplying," "averaging," "monitoring," "comparing," "applying," "updating," "measuring," "deriving" or the like, refer to the actions and processes of a computer system, or similar electronic computing device, that manipulates and transforms data represented as physical (electronic) quantities within the computer system's registers and memories into other data similarly represented as physical quantities within the computer system memories or registers or other such information storage, transmission or display devices.

The techniques described herein may be implemented in hardware, software, firmware, or any combination thereof, unless specifically described as being implemented in a specific manner. Any features described as modules or components may also be implemented together in an integrated logic device or separately as discrete but interoperable logic devices. If implemented in software, the techniques may be realized at least in part by a non-transitory computer-readable storage medium comprising instructions that, when executed, performs one or more of the methods described above. The non-transitory computer-readable storage medium may form part of a computer program product, which may include packaging materials.

The non-transitory processor-readable storage medium may comprise random access memory (RAM) such as synchronous dynamic random access memory (SDRAM), read only memory (ROM), non-volatile random access memory (NVRAM), electrically erasable programmable read-only memory (EEPROM), FLASH memory, other known storage media, and the like. The techniques additionally, or alternatively, may be realized at least in part by a processor-readable communication medium that carries or communicates code in the form of instructions or data structures and that can be accessed, read, and/or executed by a computer or other processor.

The various illustrative logical blocks, modules, circuits and instructions described in connection with the embodiments disclosed herein may be executed by one or more processors. The term "processor," as used herein may refer to any general-purpose processor, conventional processor, controller, microcontroller, and/or state machine capable of executing scripts or instructions of one or more software programs stored in memory.

As described above, the manual processes used to direct aircraft are often based on pre-filed flight plans, aviation maps, and voice instructions, each of which suffer from a number of drawbacks. For example, FIG. 1 shows an example aviation map 100, which depicts a portion of a flight path including three positions 102, 104, and 106, and two routes 108 and 110. More specifically, the aviation map 100 depicts routes 108 and 110 as straight lines that sharply intersect at position 104. However, the aviation map 100 does not depict actual flight paths. For example, if an aircraft were to fly from position 102, along route 108, to position 104, the aircraft would likely not fly in a straight line due to wind and other factors. Further, if the aircraft were to transition from route 108 to route 110, the aircraft would likely make a gradual turn, not a sharp turn onto route 110. Moreover, because the aviation map 100 is fixed (or static), the aviation map 100 may not be modified to indicate a flight path and airspeed(s) that achieve certain objectives, such as minimizing fuel consumption while maintaining a safe distance from other aircraft flying along routes 108 and 110. Thus, the aviation map 100 may not provide sufficient information for a pilot to determine a flight path that is optimized to meet certain criteria, given changing flight conditions.

Aspects of the present disclosure provide systems and methods for airspace planning that may be implemented using one or more processors. In some embodiments, an airspace planning system may be configured to dynamically plan flights for one or more aircraft (e.g., tens, hundreds, or thousands of aircraft, or some or all aircraft) in an airspace. For example, in some embodiments, the airspace planning system may obtain a first position and final position of an aircraft. The aircraft may be any manned or unmanned vehicle configured to fly, such as a fixed-wing aircraft, rotorcraft, aerostat, or rocket. The first position may represent the current position of the aircraft, or a position from which the aircraft will depart. The final position may represent the destination of the aircraft, or a position at which the aircraft will arrive. In some aspects, the first and final positions are represented in an airspace model, which is a computerized model of a multi-dimensional airspace. The airspace model may include an array of nodes, where each node represents a distinct position in the airspace and may be equidistant to other nodes in the array. Each of the first position and the final position of the aircraft may coincide with, or be proximate to, a respective node in the array.

The airspace planning system may further generate a set of flight paths in the airspace model. As used herein, the term "flight path" may refer to a route along which an aircraft may fly. In some aspects, each of the generated flight paths may include a single path element or multiple path elements adjoined in series. Each path element may connect a pair of adjacent nodes in the airspace model. Further, each path element may be associated with various attributes and may be flyable by the aircraft. As used herein, the term "flyable" refers to the ability of an aircraft to trace a given path element (or flight path) given the flight envelope of the aircraft, and/or any applicable rules, regulations, or policies. In addition to generating the set of flight paths, the airspace planning system may further obtain one or more parameters associated with each of the generated flight paths, and select an optimal flight path among the set of flight paths based on the parameters.

Because the airspace planning system may be implemented using one or more processors, the system may perform airspace planning in real-time or near real-time. Among other advantages, this permits a flight path to be automatically planned or replanned in response to changing flight conditions. Additionally, the flight path may be replanned on a continual, periodic, or ad hoc basis. Accordingly, the system provides for efficient and flexible airspace planning. Further, because the airspace planning system may simultaneously plan flights for multiple aircraft (e.g., tens, hundreds, or thousands of aircraft) in an airspace, the airspace planning system is scalable and facilitates airspace management.

Figure 2A:
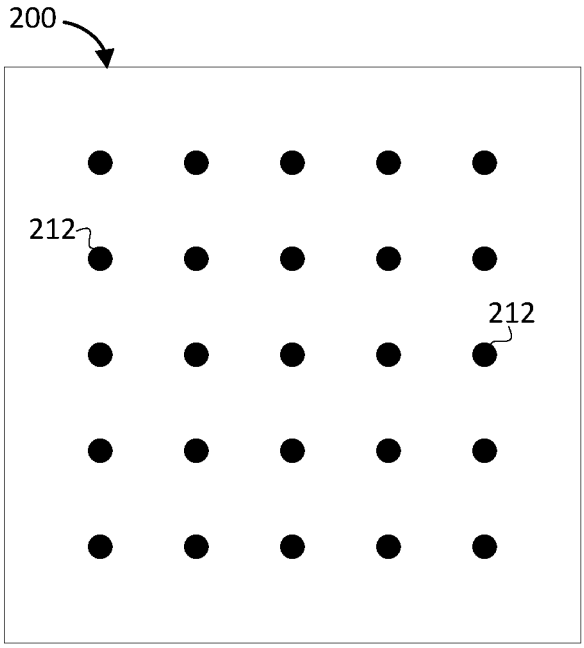
FIGS. 2A and 2B show cross sections of an example airspace model, in accordance with some embodiments.
Figure 2B:
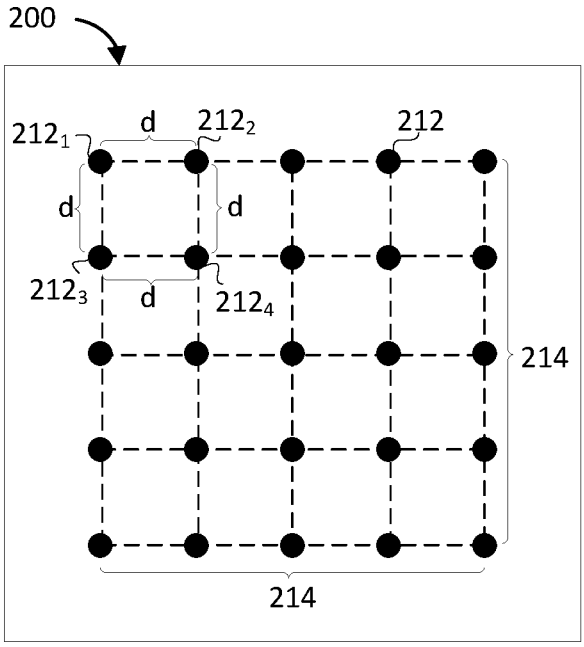

FIGS. 2A and 2B show cross sections of an example airspace model 200, in accordance with some embodiments. As described above, the airspace model 200 may be a computerized model of a multi-dimensional airspace. In some aspects, the airspace model 200 may represent an airspace and any airspace structures, flight paths, boundaries and/or regions within the airspace, in three dimensions (i.e., height, width, and depth) or four dimensions (i.e., height, width, depth, and time). However, only a cross section (or two-dimensional view) of the airspace model 200 is depicted in FIGS. 2A and 2B for simplicity.

As shown in FIG. 2A, the airspace model 200 includes an array of nodes (or discrete points) 212. Each node 212, and location between nodes 212, corresponds to a unique position in the airspace model 200, and may be represented by one or more coordinates or indices. The one or more coordinates or indices may correspond to any suitable coordinate system (e.g., a Cartesian or spherical coordinate system) or other organizational system. In some embodiments, the coordinates of a node 212 or location between nodes 212 may correspond to a latitude, longitude, and altitude. While FIGS. 2A and 2B each depict 25 nodes, the airspace model 200 may include any suitable number of nodes (e.g., thousands, millions, or billions of nodes) necessary to represent an entire airspace or portion of an airspace.

As shown in FIG. 2B, the nodes 212 are uniformly spaced such that each node 212 is equidistant to other nodes 212 in the array. For example, node 2121 is positioned a distance (d) from nodes 2122 and 2123. Similarly, node 2124 is positioned a distance (d) from nodes 2122 and 2123. Moreover, FIG. 2B shows horizontal and vertical gridlines 214, which intersect at each node 212 to form one or more 90-degree angles. As shown by the gridlines 214, the nodes 212 are aligned in rows and columns, in a rectilinear formation. In some embodiments, the nodes 212 may be arranged in other geometric formations. For example, only a subset of nodes 212 in the array may be equidistant to other nodes 212 in the array, or at least one node 212 in the array may be equidistant to multiple nodes 212 that are adjacent to (or nearby) the respective at least one node 212 in the array. As another example, the nodes 212 may be arranged in a triangular formation. The gridlines 214 in FIG. 2B are provided for illustrative purposes only, and may not be depicted in actual implementations of the airspace model 200.

Figure 3A:
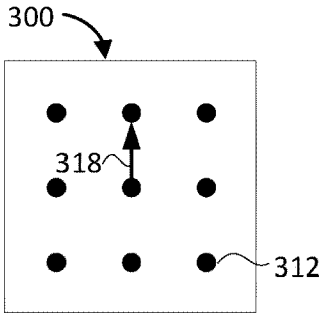
FIGS. 3A-3X show example path elements in an airspace model, in accordance with some embodiments.
Figure 3B:
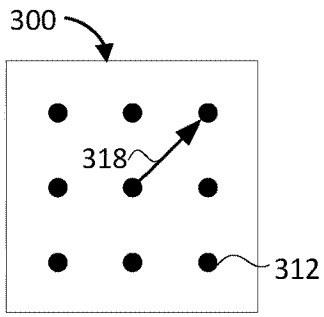
Figure 3C:
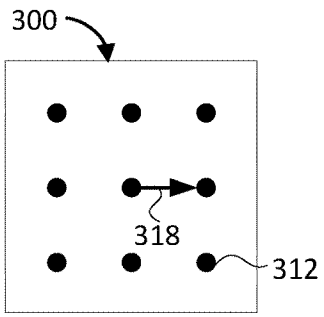
Figure 3D:
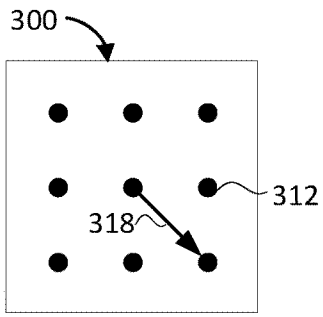
Figure 3E:
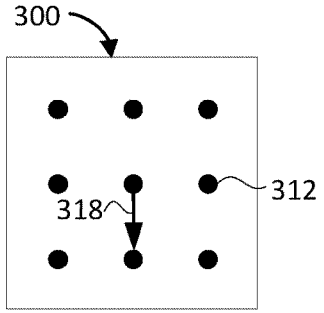
Figure 3F:
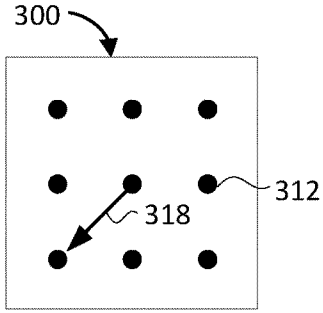
Figure 3G:
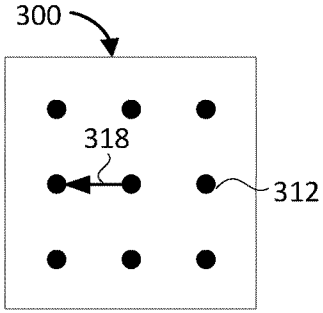
Figure 3H:
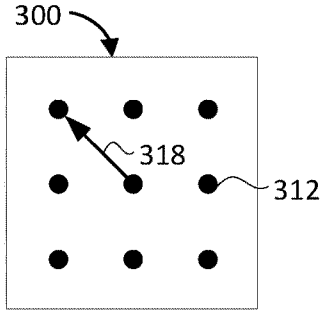
Figure 3Q:
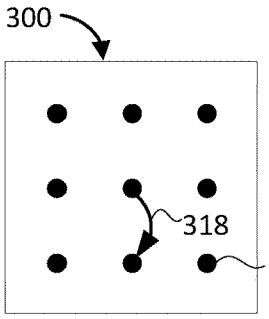
Figure 3R:
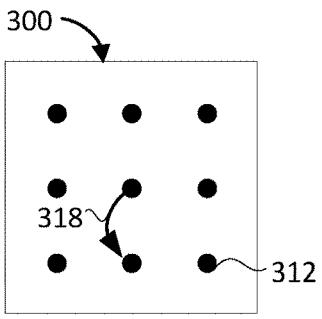
Figure 3S:
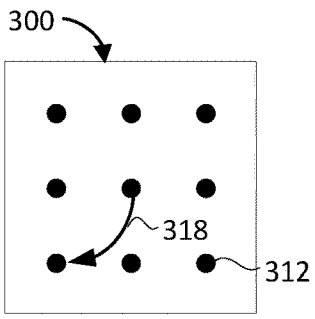
Figure 3T:
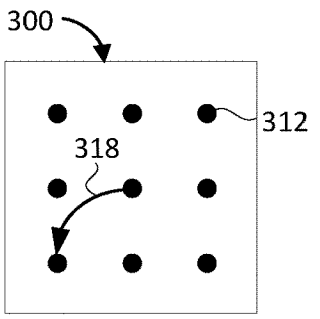
Figure 3U:
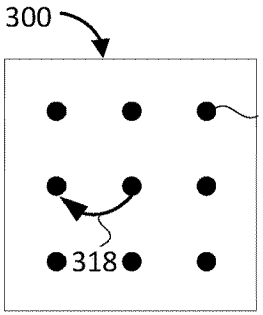
Figure 3V:
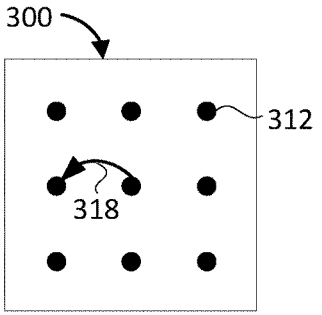
Figure 3W:
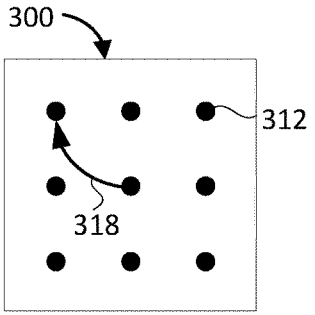
Figure 3X:
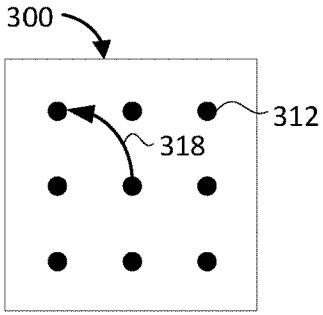

FIGS. 3A-3X show example path elements 318 in an airspace model 300, in accordance with some embodiments. The airspace model 300 may be an embodiment of the airspace model 200 of FIGS. 2A and 2B. As shown in FIGS. 3A-3X, a path element 318 connects two adjacent (or neighboring) nodes 312 in the airspace model 300. In some aspects, a path element 318 may form a flight path, segment of a flight path, pathway, segment of a pathway, boundary, and/or region of airspace. In some embodiments, a path element 318 may represent a one-dimensional entity.

As shown in FIGS. 3A-3H, a path element 318 may be linear (or substantially linear or straight) and may extend in various directions. In some aspects, a path element 318 may be linear when it forms a segment of a flight path where an aircraft may fly at higher airspeeds (e.g., toward the middle of a flight path, or away from where an aircraft takes off or lands). However, a path element 318 may be linear even when it forms a segment of a flight path where an aircraft may fly at lower airspeeds (e.g., where an aircraft takes off or lands).

As shown in FIGS. 3I-3X, a path element 318 may be curved (or substantially non-linear) and extend in various directions. In some aspects, a path element 318 may be curved when it forms a segment of a flight path that is located near the end point of the flight path (e.g., a particular runway). Further, in some embodiments, a path element 318 may exhibit a curvature that is custom and/or non-standard (e.g., non-canonical) when the path element 318 forms a segment of a flight path that is disposed near the end point of the flight path. However, a path element 318 may be curved even when it forms a segment of a flight path that is near the initial position or middle of the flight path. Moreover, in some embodiments, a curved path element 318 may be flyable where the radius of the curved path element 318 is sufficiently long such that an aircraft may safely fly along the curved path element 318 at a particular airspeed (or safely turn) in accordance with a rule, regulation, or policy (e.g., an airline policy limiting a bank angle to 20 degrees).

In some implementations, the length of a path element 318 may determine, or be determined by, the shape of the path element 318. In some aspects, a path element 318 may be any length suitable for flight (or airspace) planning. For example, in some embodiments, a path element 318 may span several miles or kilometers. Further, the shape of a path element 318 may conform to an aircraft's flight envelope and any applicable rules, regulations, or policies. As used herein, the term "flight envelope" may refer to the capabilities or operational boundaries of an aircraft in terms of the aircraft's airspeed, load factor, altitude, and/or maneuverability. In actual implementations, the path elements 318 may be implemented with different shapes or trajectories than those depicted in FIGS. 3A-3X.

In some embodiments, there may be various categories or types of path elements 318 that can be used to define flight paths, pathways, boundaries or regions in airspace model 300. The path elements 318 may be categorized based on their shape or geometry (e.g., one or more angles, directions, or locations), or other attributes. In some other embodiments, a single, universal path element may be used to define a flight path, pathway, boundary, or region in the airspace model 300.

FIGS. 4A-4H show how an example path element 418A may be linked to another path element in an airspace model 400, in accordance with some embodiments. The airspace model 400 may be an embodiment of the airspace models 200 and/or 300, described with reference to FIGS. 2A, 2B and 3A-3X. In some embodiments, the path element 418A may be linked to another path element to generate a flight path. In other embodiments, the path element 418A may be linked to other path elements to form an airspace structure in which flight paths may be generated or defined. In yet other embodiments, the path element 418A may be linked to other path elements to define an exclusive airspace or other region of airspace.

Figure 4A:
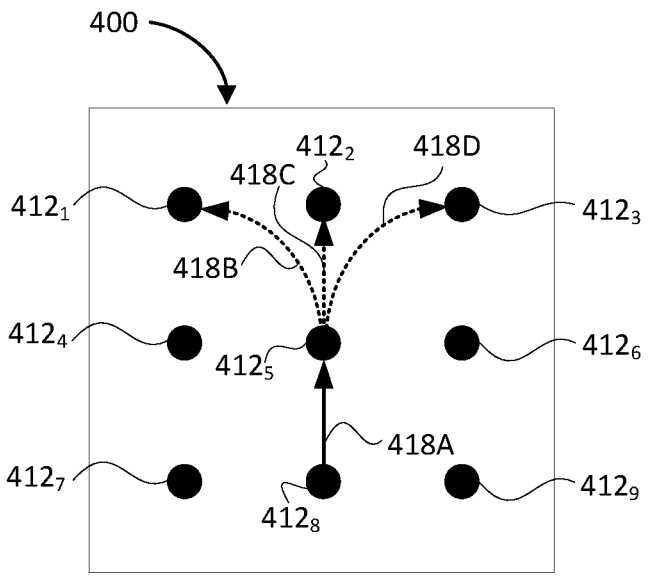
FIGS. 4A-4H show how an example path element may be linked to another path element in an airspace model, in accordance with some embodiments.

As shown in FIG. 4A, the example path element 418A extends from node 4125 to node 4125. That is, the tail (or origin) of path element 418A is located at node 4125, and the head (or destination) of path element 418A is located at node 4125. In some aspects, the head of path element 418A may be linked or adjoined to the tail of another path element such that the two path elements are smoothly linked in series and safely flyable by an aircraft. Put differently, the head of path element 418A may be connected to the tail of another path element that extends from node 4125 to a node that is adjacent to node 4125. For example, the path element 418A may be connected to path elements 418B, 418C, or 418D, which terminate at nodes 4121, 4122, and 4123, respectively. As shown in FIG. 4A, in some aspects, where an aircraft flies along (or traces) the path element 418A, the aircraft may fly straight through the head of the path element 418A, at node 4125. That is, the aircraft may not turn as the aircraft passes through the head of path element 418A. Further, in some aspects, the aircraft may turn between nodes as shown by path elements 418B and 418D in FIG. 4A. It is noted that the shape, direction, and position of each of path elements 418A-418D are merely examples.

Figure 4B:
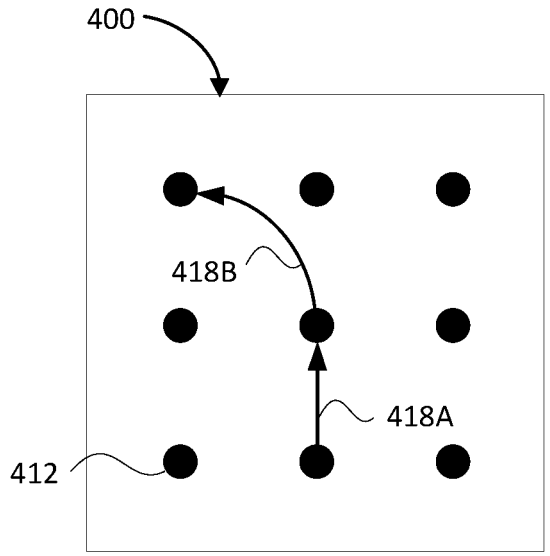
Figure 4C:
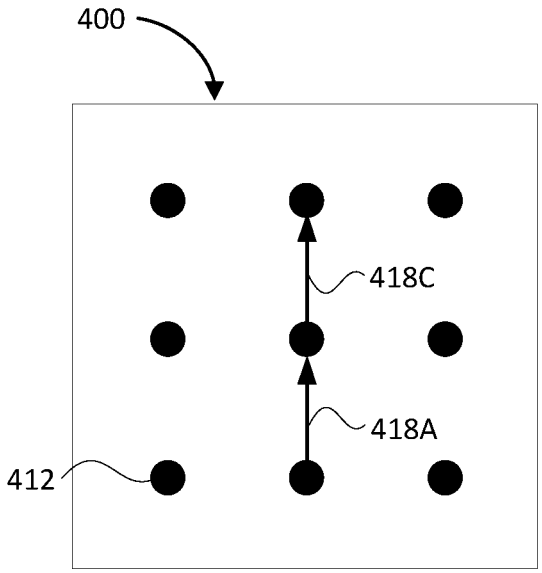
Figure 4D:
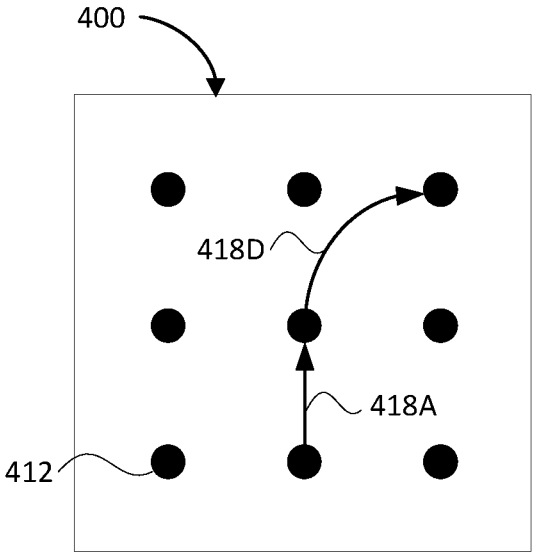

FIGS. 4B, 4C, and 4D show path element 418A linked to path elements 418B, 418C, and 418D, respectively, in the airspace model 400. In some aspects, the linked path elements 418 shown in FIGS. 4B-4D may be linked in series to additional path elements. For example, with reference to FIG. 4B, the head of path element 418B may be connected to the tail of another path element, the head of which may be connected to the tail of yet another path element. This process may be continued until a desired flight path, pathway, boundary, or region of airspace is defined.

In some embodiments, the path elements 418 may be linked based on one or more rules associated with a combinatorial model. The rules may relate to, for example, the shape, geometry, or other attribute of a path element; the geometric formation of nodes in an airspace model; a flight path; aircraft; and/or flight condition. For example, in some embodiments, the combinatorial model may apply a rule that the path element 418A may only be connected to another path element (e.g., "path element X") such that the head of path element 418A is linked to the tail of path element X, where: (i) the path element X extends in a particular direction; and (ii) terminates at a node adjacent to, and located at a particular angle (or position) relative to, the head of path element 418A. When applying this rule, the combinatorial model may determine, for example, that the path element 418A may only be connected to a path element that extends straight to node 4122, left to node 4121, or right to node 4123, as shown in FIG. 4A.

Figure 4E:
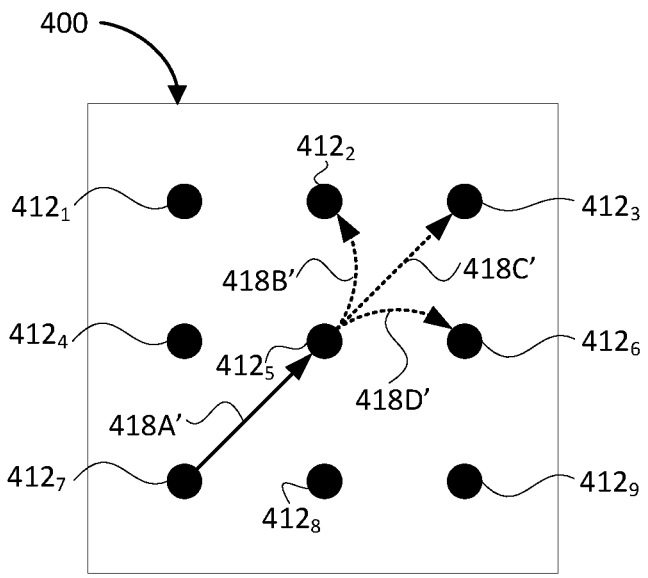
Figure 4F:
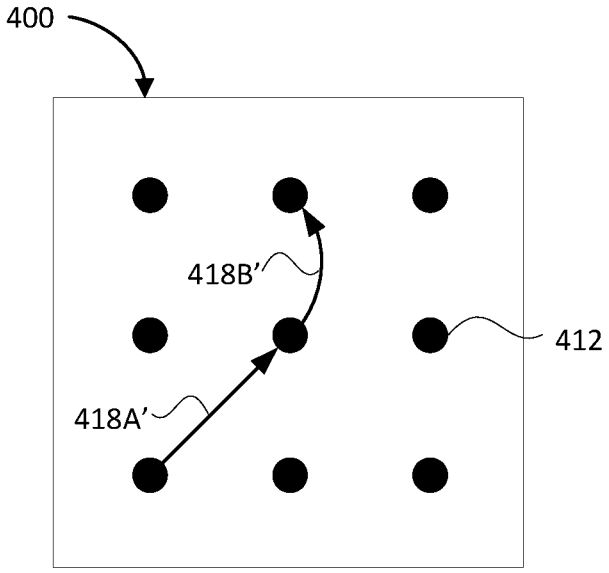
Figure 4G:
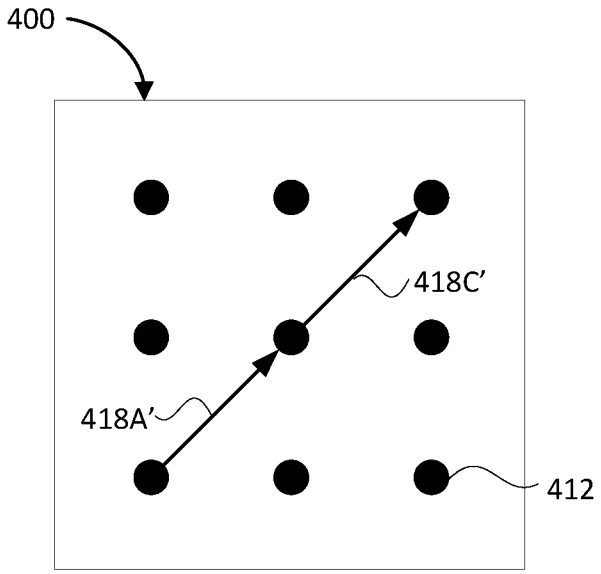
Figure 4H:
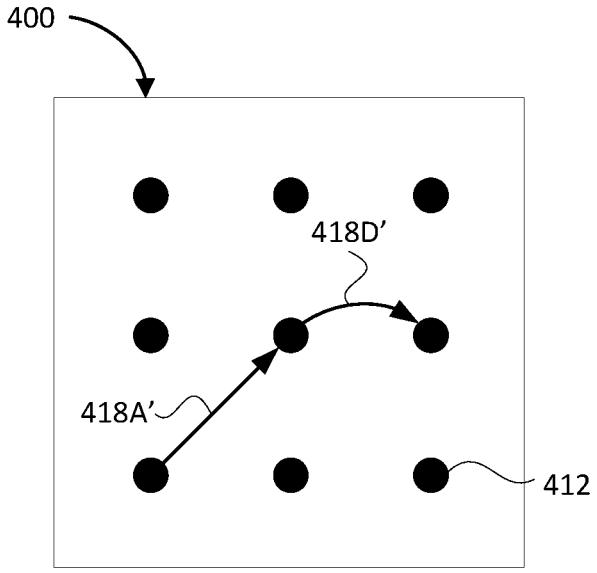

Additional examples of how path elements may be linked are provided in FIGS. 4E-4H. As shown in FIG. 4E, the example path element 418A' extends from node 4127 to node 4125, and may be linked to path element 418B', 418C', or 418D'.

Figure 5A:
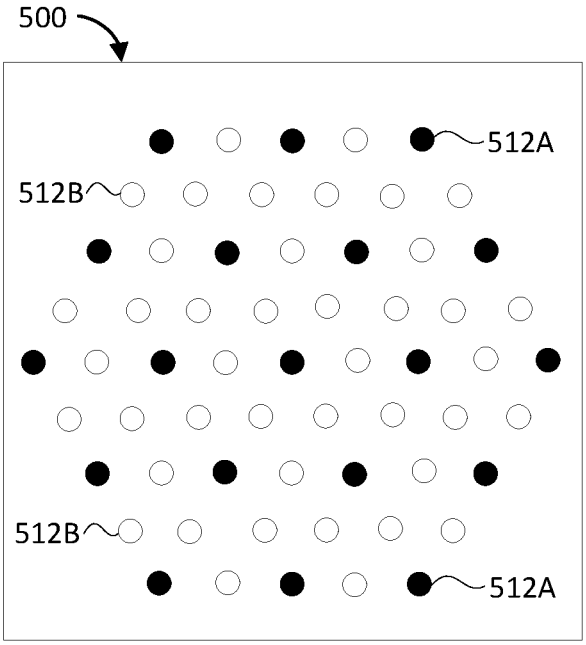
FIGS. 5A and 5B show cross sections of an example airspace model, in accordance with some embodiments.
Figure 5B:
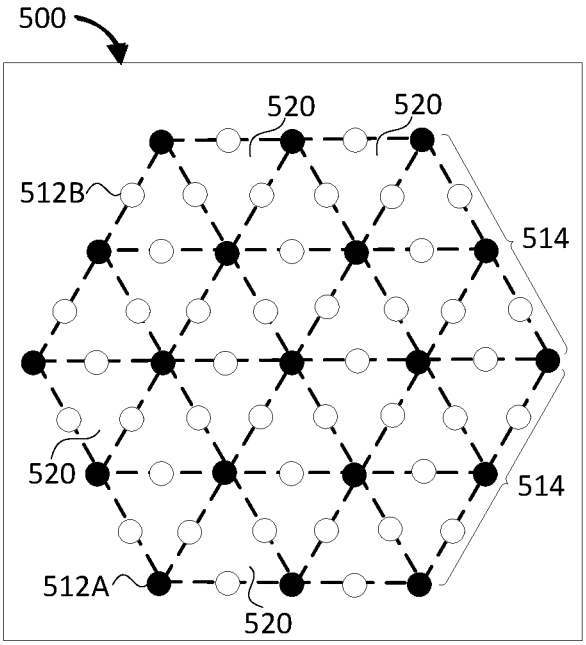

FIGS. 5A and 5B show cross sections of an example airspace model 500, in accordance with some embodiments. The airspace model 500 may be an embodiment of the airspace models 200, 300 and/or 400, described above with reference to FIGS. 2A, 2B, 3A-3X, and 4A-4H.

As shown in FIG. 5A, the airspace model 500 includes an array of nodes 512A and 512B. Each of the nodes 512A is shown as a black dot, and each of the nodes 512B is shown as a white dot with a black rim. Like the nodes 212 of FIG. 2B, nodes 512A ("black nodes 512A") and 512B ("white nodes 512B") of FIG. 5A are evenly spaced such that each node 512A or 512B is equidistant to other nodes in the array. However, the nodes 512A and 512B are arranged differently from the nodes 212 of FIG. 2B. In some embodiments, only a subset of black nodes 512A and/or white nodes 512B may be equidistant to other nodes in the array.

FIG. 5B shows gridlines 514, where each gridline 514 passes through an alternating sequence of nodes 512A and 512B, and intersects with other gridlines 514. As shown in FIG. 5B, the nodes 512A and 512B are arranged in a triangular formation composed of triangles 520. Each black node 512A is located at a vertex of a triangle 520, while each white node 512B is located at the midpoint of a side of a triangle 520. Relative to nodes in a rectilinear formation (as shown in FIGS. 2A and 2B), the nodes 512A and 512B of FIG. 5B exhibit more symmetry. In some embodiments, this increased symmetry of nodes 512A and 512B may facilitate the generation of flight paths in airspace model 500. That is, the symmetry of nodes 512A and 512B may simplify the mathematics used by a combinatorial model to generate a set of flight paths. The gridlines 514 in FIG. 5B are provided for illustrative purposes only, and may not be depicted in actual implementations of the airspace model 500.

FIGS. 6A-6D show example path elements 618 in airspace model 600, in accordance with some embodiments. The airspace model 600 may be an embodiment of the airspace models 200, 300, 400, and/or 500, described above with reference to FIGS. 2A, 2B, 3A-3X, 4A-4H, 5A, and 5B. In some aspects, a path element 618 may form a flight path, segment of a flight path, pathway, segment of a pathway, boundary, and/or region of airspace.

Figure 6B:
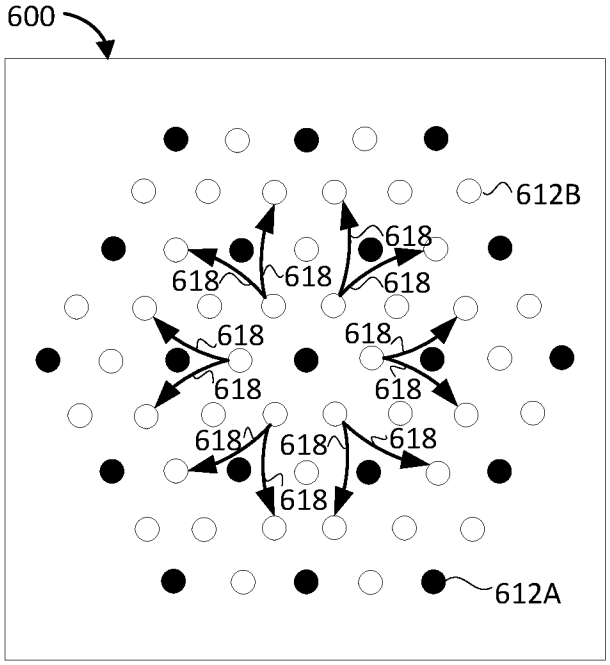
FIGS. 6A-6D show example path elements in an airspace model, in accordance with some embodiments.
Figure 6A:
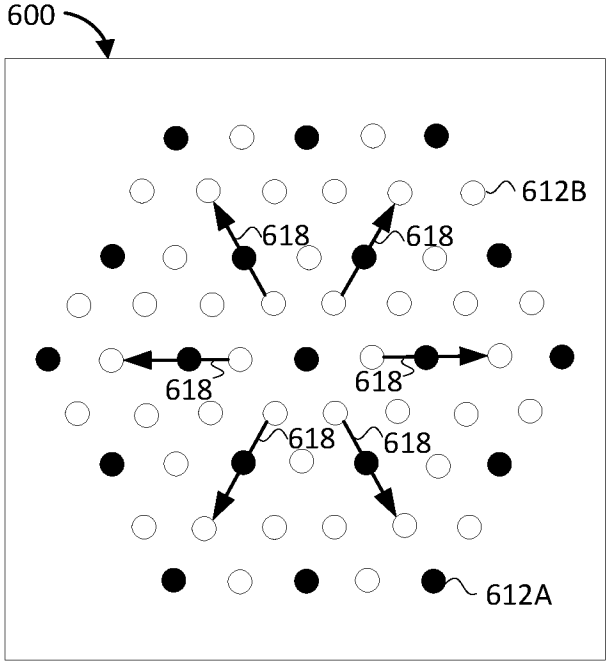

In some embodiments, a path element 618 may extend from one white node 612B to an adjacent white node 612B. For example, as shown in FIG. 6A, each of the path elements 618 originates at a white node 612B, passes linearly through a black node 612A, and terminates at an adjacent white node 612B. As another example, as shown in FIG. 6B, each of the path elements 618 originates at a white node 612B, curves to the side of a black node 612A, and terminates at an adjacent white node 612B.

Figure 6C:
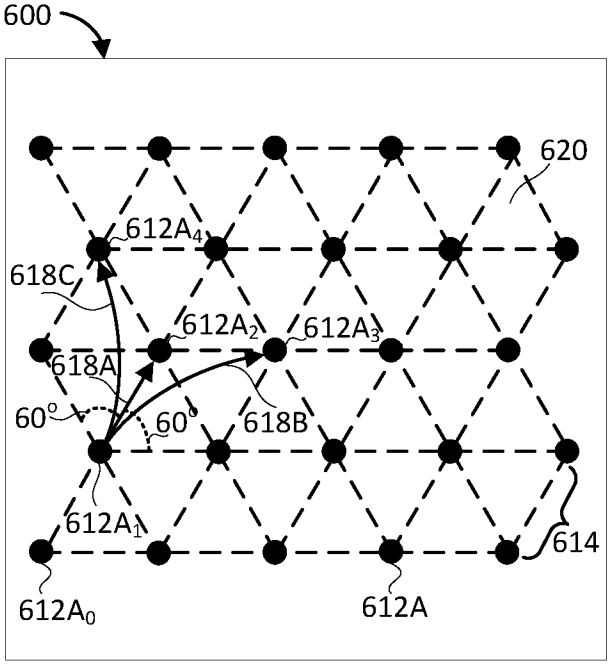

In some embodiments, a path element 618 may extend from one black node 612A to an adjacent black node 612A. For example, as shown in FIG. 6C (in which white nodes 612B are not shown for simplicity), a path element 618A originates at the black node $612A_1$ and extends linearly to the black node $612A_2$. FIG. 6C also shows a path element 618B, which originates at the black node $612A_1$, and curves to the right of black node $612A_2$ to terminate at black node $612A_3$. FIG. 6C further depicts a path element 618C, which originates at the black node $612A_1$, and curves to the left of black node $612A_2$ to terminate at a black node $612A_4$. While not shown in FIG. 6C, in some embodiments, a path element 618 may extend from a black node 612A to an adjacent white node 612B, or from a white node 612B to an adjacent black node 612A.

As explained above with reference to FIG. 5B, the black nodes 612A of FIG. 6C are arranged in a triangular formation (or triangular lattice structure) composed of triangles 620. As shown by gridlines 614, each black node 612A is positioned at a vertex of a triangle 620. In some embodiments, an aircraft may fly along a linear path element 618 that coincides with the side of a triangle 620, and once the aircraft flies straight through a black node 612A, the aircraft may fly in one of three directions. For example, where the aircraft flies from the black node $612A_0$, along a linear path element 618 (not shown in FIG. 6C) to the black node $612A_1$, the aircraft may (i) continue to fly linearly along the path element 618A to the black node $612A_2$; (ii) turn right to fly along curved path element 618B to black node $612A_3$ (e.g., a 60° turn as shown in FIG. 6C); or (iii) turn left to fly along the curved path element 618C to black node $612A_4$ (a 60° turn, as shown in FIG. 6C). Aspects of the present disclosure recognize that in order for the aircraft to turn, the aircraft may tip one of its wings (or assume a desired bank angle). As the aircraft tips its wing, the aircraft begins to fly along a curved path element (e.g., path element 618B or 618C), which may form part of the circumference of a circle. The radius of the circle may be related to the aircraft's wing angle and speed.

Figure 6D:
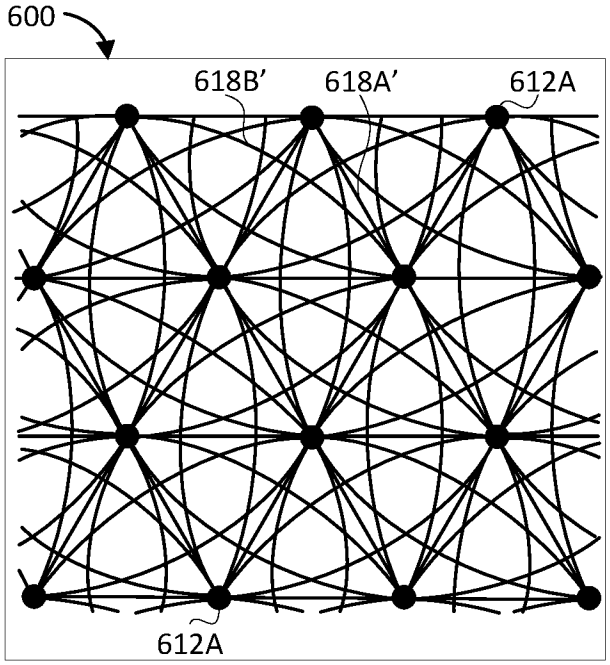

FIG. 6D shows path elements 618, where each path element 618 extends from one black node 612A to an adjacent black node 612A, and is linear or curved. For simplicity, in FIG. 6D, only some path elements 618 are annotated, and arrowheads indicating the directions of the path elements 618 are not shown. In some embodiments, each linear path element 618A' may have the same length, and each curved path element 618B' may have the same length and the same curvature. As a result, the path elements 618 may exhibit a symmetry through the airspace model 600, which supports simple and efficient flight path algorithms, and efficient combinatorics and combinatoric searches for optimal flight paths. Further, as shown in FIG. 6D, the triangular lattice structure of the black nodes 612A may support a large number of path elements 618, which may be used to define a large number of flight paths. In some aspects, each path element 618 of the airspace model 600 may be flyable by an aircraft. It is noted that the shape of each path element 618 shown in FIGS. 6A-6D is merely an example.

Figure 7B:
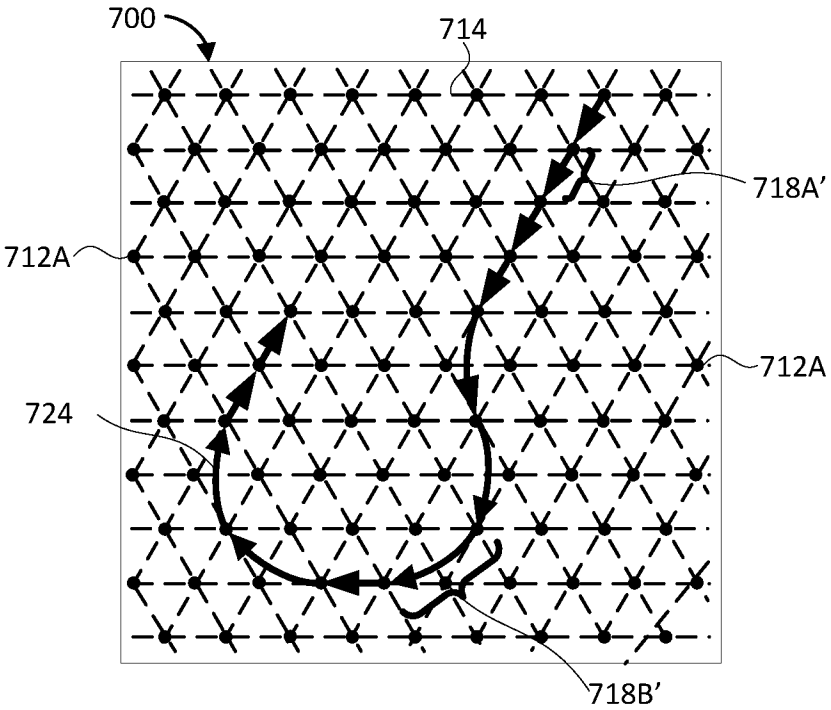
FIGS. 7A and 7B show how example path elements may be linked in an airspace model, in accordance with some embodiments.
Figure 7A:
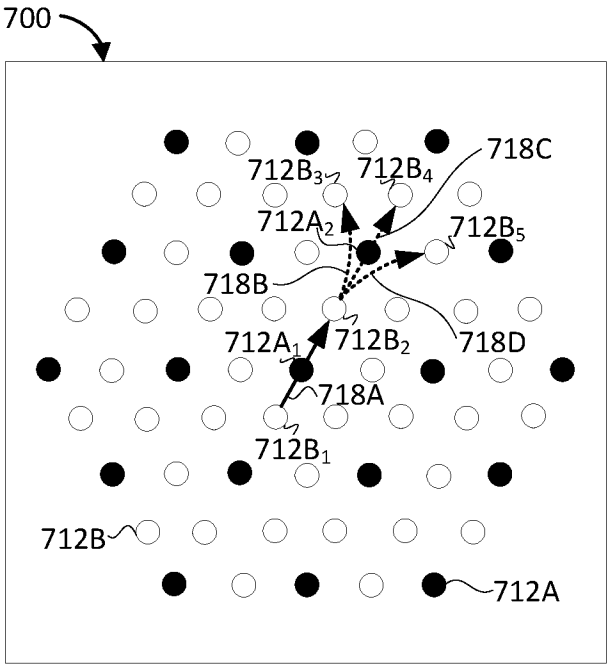

FIG. 7A shows how example path elements 718 may be linked in an airspace model 700, in accordance with some embodiments. The airspace model 700 may be an embodiment of the airspace models 200, 300, 400, 500 and/or 600, described above with reference to FIGS. 2A, 2B, 3A-3X, 4A-4H, 5A, and 6A-6D. As shown in FIG. 7A, the example path element 718A extends from white node $712B_1$ to white node $712B_2$. In some embodiments, the head of path element 718A may be connected to the tail of another path element that extends from white node $712B_2$ to another white node $712_B$ that is adjacent to white node $712B_2$. For example, as shown in FIG. 7A, the path element 718A may be connected to one of path elements 718B, 718C, or 718D, the heads of which are located at white nodes $712B_3$, $712B_4$, and $712B_5$, respectively. It is noted that the shape, direction, and position of each of path elements 718A-718D are merely examples. Further, the geometric formation of nodes 712A and 712B in airspace model 700 is merely an example.

In some embodiments, the path elements 718 may be linked based on one or more rules associated with a combinatorial model, as described above with reference to FIGS. 4A-4H. For example, in some embodiments, the combinatorial model may apply a rule that the path element 718A may only be connected to another path element (e.g., "path element Y") such that the head of path element 718A is linked to the tail of path element Y, where: (i) the path element Y extends in a particular direction; and (ii) terminates at a white node 712B adjacent to, and located at a particular angle (or position) relative to, the head of path element 718A. When applying this rule, the combinatorial model may determine, for example, that the path element 718A may only be connected to a path element that extends straight to white node $712B_4$, left to white node $712B_3$, or right to white node $712B_5$, as shown in FIG. 7A.

The combinatorial model may apply a similar rule for linking path elements where each of the path elements to be linked extends from a black node 712A to an adjacent black node 712A. For example, with reference to FIG. 6C, the combinatorial model may apply a rule that a path element 618 extending from black node $612A_0$ to black node $612A_1$ (also referred to as "path element 618X," which is not shown in FIG. 6C) may only be connected to another path element (e.g., "path element Z") such that the head of the path element 618X is linked to the tail of path element Z, where: (i) the path element Z extends in a particular direction; and (ii) terminates at a black node 612A adjacent to, and located at a particular angle (or position) relative to, the head of path element 618X. When applying this rule, the combinatorial model may determine, for example, that the path element 618X may only be connected to a path element that extends straight to black node $612A_2$, right to black node $612A_3$, or left to black node $612A_4$, as shown in FIG. 6C.

FIG. 7B shows an example flight path 724 that includes linear path elements 718A' and curved path elements 718B', which are linked in series. FIG. 7B also shows that each path element 718 extends from one black node 712A to an adjacent black node 712A. In some embodiments, each linear path element 718A' may have the same length, and each curved path element 718B' may have the same length and the same curvature. As shown in FIG. 7B, an aircraft that flies along the flight path 724 passes straight through various black nodes 712A, and turns only between the black nodes 712A, along a curved path element 718B'. As described above with reference to FIG. 6C, a curved path element 718B' may form part of the circumference of a circle, and the radius of the circle may be a trigonometric quadratic function of the aircraft's speed and wing angle, but not the aircraft's size.

While FIG. 7B depicts only a two-dimensional bird's eye view (or latitudinal and longitudinal-type dimensions) of the airspace model 700, the airspace model may account for additional dimensions, such as altitude and time. In some embodiments, during the cruise (or mid) portion of a flight path, an aircraft's altitude may be constant or nearly constant. Further, as discussed above with reference to FIGS. 3I-3X and FIG. 4A, the flight path 724 may be flyable, permit a range of airspeeds, and conform with any pertinent rules, regulations or policies (e.g., standard procedures for the ascent and descent portions of the flight path 724).

Figure 7D:
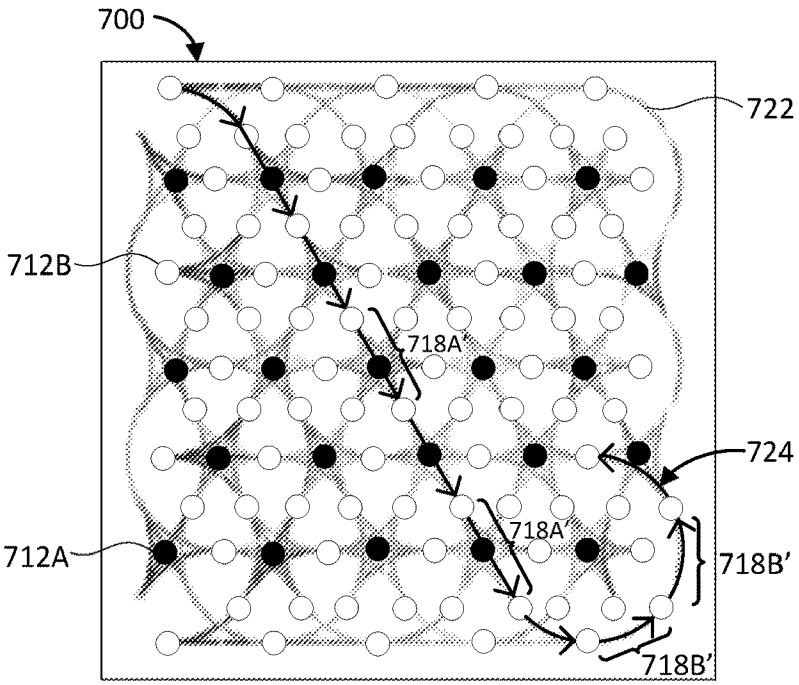
FIGS. 7C and 7D show example airspace structures in an airspace model, in accordance with some embodiments.
Figure 7C:
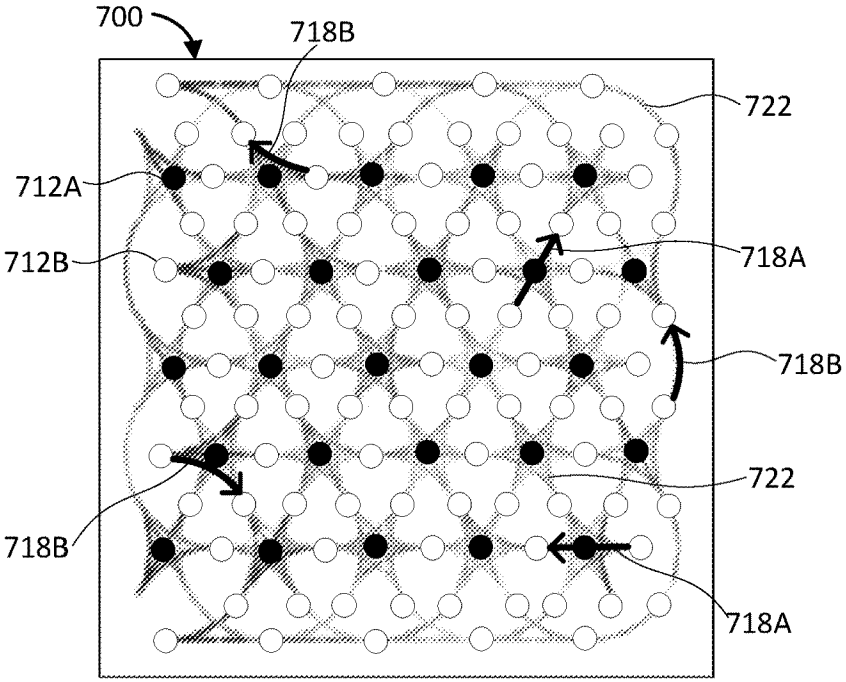

FIGS. 7C and 7D show example airspace structures 722 in airspace model 700, in accordance with some embodiments. As shown in FIG. 7C, the airspace structure 722 is formed by linear path elements 718A and curved path elements 7188. In some aspects, the airspace structure 722 represents a set of pathways, where each pathway is formed by one or more of path elements 718A and/or 7188, which may be linked to one another. In some embodiments, one or more flight paths may be generated from or defined by one or more pathways in the airspace structure 722. It is noted that only some of linear path elements 718A and curved path elements 718B are annotated in FIG. 7C for simplicity. Further, the shape and direction of each of path elements 718A and 718B are merely examples. While not shown in FIG. 7C, in some embodiments, a linear or curved path element 718 may extend from a black node 712A to an adjacent white node 7128, or from a white node 7128 to an adjacent black node 712A, in order to form the airspace structure 722.

In some embodiments, the airspace structure 722 may be generated based on a combinatorial model. The combinatorial model may generate each of path elements 718A and 7188 to form the airspace structure 722 (or pathways of airspace structure 722). In some embodiments, the combinatorial model may generate a set of all possible path elements to form an airspace structure 722. For example, the set of all possible path elements may include path elements that extend between every combination of two adjacent nodes. Further, the set of all possible path elements may include path elements of all shapes and directions, and may include hundreds, thousands, millions or billions of path elements, some or all of which may be linked. Further, in some embodiments, each path element of the set of all possible path elements may be flyable by one or more aircraft.

In some embodiments, the combinatorial model may apply one or more rules to generate path elements 718A and 718B of airspace structure 722. For example, to generate a linear path element 718A, the combinatorial model may apply a rule that the linear path element 718A must begin at a white node 712B and extend linearly through a black node 712A before terminating at an adjacent white node 712B. As another example, to generate a curved path element 718B, the combinatorial model may apply a rule that the path element 718B must (i) originate at a white node 712B; (ii) extend in a particular direction; (iii) exhibit a particular curvature; (iv) not pass through any black node 712A; and (iv) terminate at a white node 712B that is adjacent to, and located at a particular angle (or position) relative to, the tail of path element 718B. In some embodiments, the combinatorial model may apply one or more rules to link (or merely assemble or orient) path elements to form an airspace structure (or pathways of an airspace structure), as described above with reference to FIGS. 4A-H and 7A.

As shown in FIG. 7D, the airspace structure 722 is used to form example flight path 724. The example flight path 724 includes linear path elements 718A' and curved path elements 718B', which are linked in series. In some aspects, the flight path 724 may include or be defined by a pathway of airspace structure 722.

In some embodiments, a combinatorial model may be used to generate a set of all possible pathways (e.g., candidate pathways) within an airspace structure. The set of all possible pathways may be assembled from a set of all possible path elements, as discussed above. Further, the set of all possible pathways may include pathways of all possible lengths, shapes or trajectories, starting points, and ending points in the airspace structure 722. In some embodiments, each pathway of the set of all possible pathways may be flyable by one or more aircraft. Further, in some embodiments, a combinatorial model may be used to generate or define one or more flight paths (e.g., candidate flight paths) based on the set of all possible pathways. In some aspects, each of the one or more flight paths may correspond to a respective pathway in the set of all possible pathways.

Figure 8:
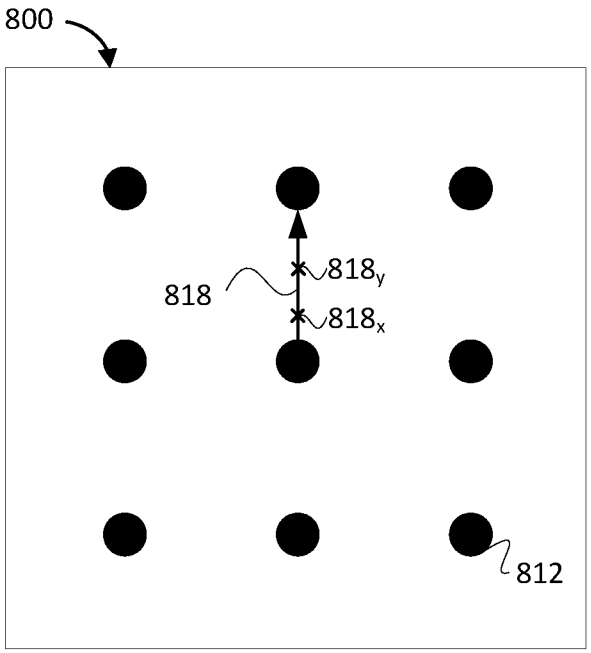
FIG. 8 shows example attributes associated with a path element in an airspace model, in accordance with some embodiments.

FIG. 8 shows example attributes 826 associated with a path element 818 in an airspace model 800, in accordance with some embodiments. The airspace model 800 may be an embodiment of the airspace models 200, 300, 400, 500, 600 and/or 700, described above with reference to FIGS. 2A, 2B, 3A-3X, 4A-4H, 5A, 5B, 6A-6D and 7A-7D.

In some embodiments, the attributes 826 may be associated with a single point or position on path element 818, a segment of path element 818, the entire path element 818, an aircraft that may fly along (or trace) path element 818, and/or the airspace occupied by path element 818. Further, each attribute 826 may be associated with one or more values expressed by one or more numbers, letters, and/or other symbols. In some embodiments, the attributes 826 may include one or more of a path element identifier; position; distance; time; time period; amount of fuel; cost; wind vector (representing, for example, a headwind, tailwind, and/or crosswind); weather indication (e.g., fog, rain, ice, lightening, turbulence); airspeed; ground speed; aircraft identifier; descent rate; climb rate; pitch; roll (i.e., bank angle); yaw; position of control surface (e.g., flap, aileron, rudder, elevator, spoiler, slat, or air brake), throttle lever angle; angle of attack; turn rate; turn radius; runway identifier and/or direction; wheel configuration (e.g., wheels up or down on an aircraft); a noise level (e.g., noise emitted by an aircraft); or a noise restriction (e.g., a noise limitation provided in a rule, regulation, or policy). The aircraft identifier attribute may represent an aircraft that flies along or plans to fly along (or trace) the path element 818. The position attribute may represent a position along the path element 818 (e.g., position 818*k* or position 818*y* shown in FIG. 8). The cost attribute may represent a cost associated with an aircraft that flies along (or traces) path element 818, such as an operational cost or cost of fuel. In some embodiments, the attributes 826 may be updated continually, periodically, or on an ad hoc basis to reflect real-time and/or changing flight conditions.

In some embodiments, the attributes 826 may be generated by a combinatorial model. Further, in some embodiments, the attributes 826 may be generated based on the path element 818, or the path element 818 may be generated based on the attributes 826. Still further, in some embodiments, one or more flight paths may be generated based on the attributes 826 and path element 818. In some aspects, one or more the attributes 826 may represent or be associated with a constraint or condition to be optimized.

Figure 9:
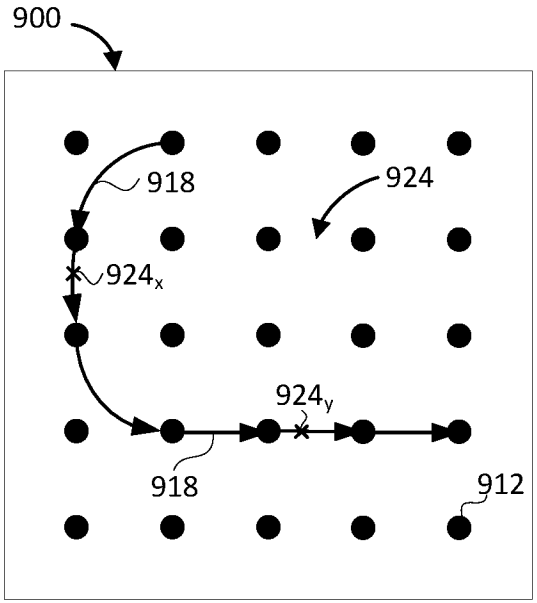
FIG. 9 shows example parameters associated with a flight path in an airspace model, in accordance with some embodiments.

FIG. 9 shows example parameters 928 associated with a flight path 924 in airspace model 900, in accordance with some embodiments. The airspace model 900 may be an embodiment of the airspace models 200, 300, 400, 500, 600 700, and/or 800, described above with reference to FIGS. 2A, 2B, 3A-3X, 4A-4H, 5A, 5B, 6A-6D, 7A-7D, and 8.

As shown in FIG. 9, the example parameters 928 are associated with the flight path 924, which includes path elements 918. In some embodiments, the parameters 928 may be associated with a single point or position on flight path 924, a segment of flight path 924, the entire flight path 924, an aircraft that may fly along (or trace) flight path 924, and/or the airspace occupied by flight path 924. Further, each of parameters 928 may be associated with one or more values expressed by one or more numbers, letters, and/or other symbols. In some embodiments, the parameters 928 may include one or more of a flight path identifier; position; distance; time; time period; amount of fuel; cost; weather condition(s); noise level; runway direction, exclusive airspace; or any attributes associated with path elements 918. In some embodiments, the position parameter may represent a position along the flight path 924 (e.g., position 924*k* or position 924*y* shown in FIG. 9). In some embodiments, the distance parameter may represent the length of flight path 924. In some embodiments, the distance parameter may represent a distance between a position on flight path 924 and another flight path or aircraft. In some embodiments, the parameters 928 may be updated continually, periodically, or on an ad hoc basis to reflect real-time and/or changing flight conditions. It is noted that the shape or trajectory of flight path 924 and path elements 918, and the formation of nodes 912 in airspace model 900, are merely examples.

In some embodiments, the parameters 928 may be generated by a combinatorial model. Further, in some embodiments, the example parameters 928 may be generated based on the flight path 924, or flight path 924 may be generated based on the parameters 928. In some aspects, one or more example parameters 928 may represent or be associated with a constraint or condition to be optimized.

Figure 10:
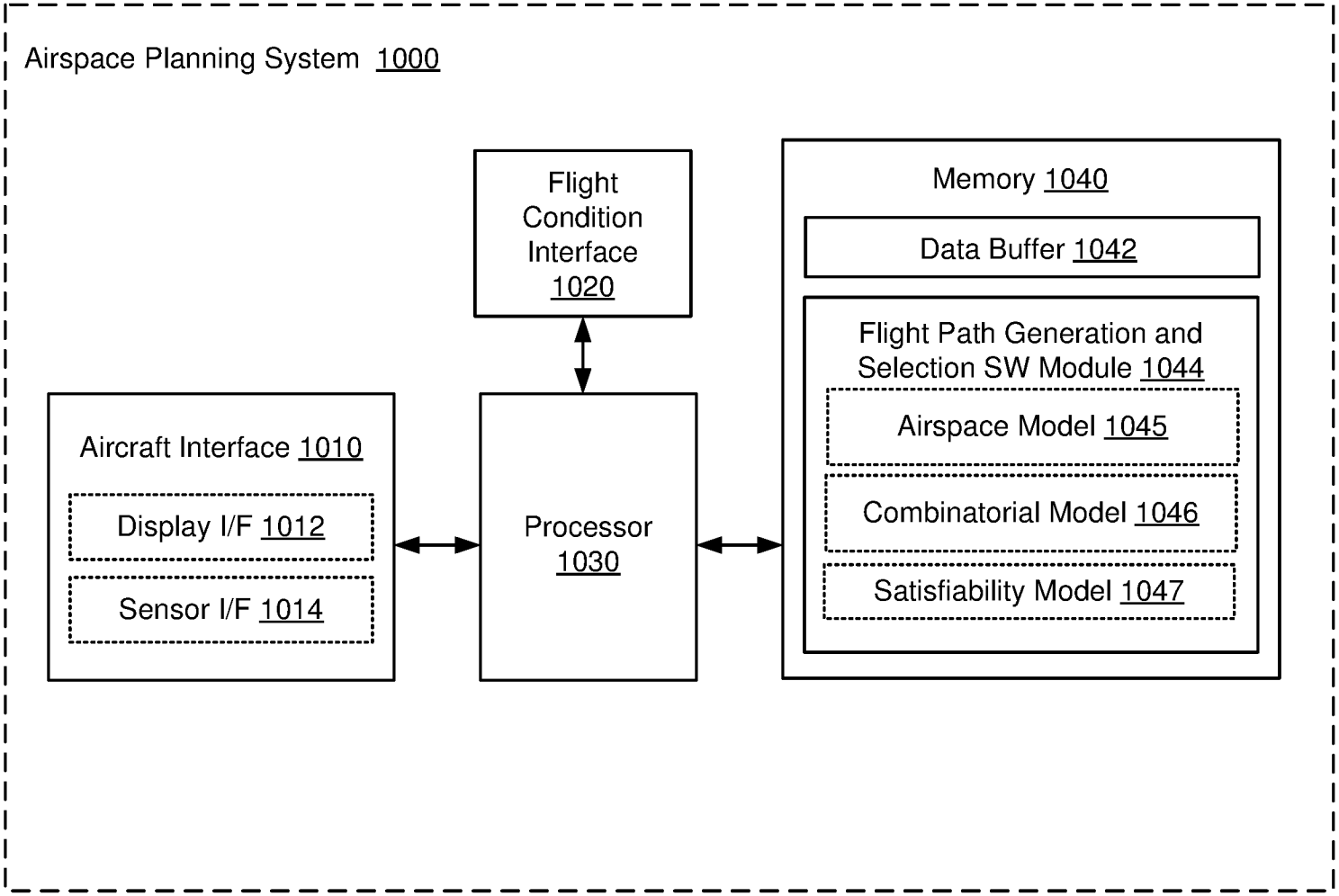
FIG. 10 shows a block diagram of an airspace planning system, in accordance with some embodiments.

FIG. 10 shows a block diagram of an airspace planning system 1000, in accordance with some embodiments. The airspace planning system 1000 includes an aircraft interface 1010, flight condition interface 1020, processor 1030, and memory 1040. For purposes of discussion herein, the processor 1030 is shown in FIG. 10 as being coupled to the aircraft interface 1010, flight condition interface 1020, and the memory 1040. For actual embodiments, the aircraft interface 1010, the flight condition interface 1020, the processor 1030, and/or the memory 1040 may be connected together using one or more buses (not shown for simplicity). It is noted that, in some embodiments, the airspace planning system 1000 may be an application specific integrated circuit (ASIC) or other integrated circuit (IC) disposed on, or associated with, one or more (e.g., tens, hundreds, or thousands of) manned and/or unmanned aircraft, and/or electronic systems, that include airspace model 200, 300, 400, 500, 600 700, 800 and/or 900, described above with reference to FIGS. 2A, 2B, 3A-3X, 4A-4H, 5A, 5B, 6A-6D, 7A-7D, 8, and 9. Further, in some embodiments, one or more operations of the airspace planning system 1000 may be performed on a centralized electronic system (e.g., a computing system). In some other embodiments, one or more operations of the airspace planning system 1000 may be distributed across, for example, multiple aircraft and/or electronic systems. Further, in some embodiments, access to and/or storage of information used or generated by the airspace planning system 1000 may be restricted. For example, some or all information used or generated by the airspace planning system 1000 to plan flights for a particular aircraft in an airspace may be stored on and/or accessible to only one or more of the following entities: the aircraft, a centralized electronic system, other electronic systems, some other aircraft in the airspace, or all aircraft in the airspace.

The aircraft interface 1010 may transmit and receive signals to and from one or more displays (and/or other input devices), and/or aircraft sensors (not shown for simplicity). In some embodiments, the aircraft interface 1010 may include a display interface 1012 and sensor interface 1014. The display interface 1012 may be used to communicate with a display and/or to provide a visual interface to a user of the airspace planning system 1000 (e.g., a pilot, an aircraft operator, and/or an air traffic controller). For example, the display interface 1012 may communicate information relating to an aircraft's flight plan (e.g., flight path, parameters, path elements, and/or attributes), flight conditions, controls, sensors, and/or avionics. The sensor interface 1014 may be used to communicate with and/or control sensors or avionics of an aircraft. For example, the sensor interface 1014 may transmit activation signals to and receive sensor information from an aircraft's navigation system, control system, or propulsion system to direct the aircraft along a flight path. The flight condition interface 1020 may be used to communicate information between a designated aircraft and other aircraft, weather stations, ATC, and/or other entities. For example, the flight condition interface 1020 may transmit information to, and receive information from, other aircraft to update the flight plan for the designated aircraft.

The memory 1040 may include a data buffer 1042 to store information received via the display interface 1012, sensor interface 1014, and/or flight condition interface 1020. The memory 1040 may also include a non-transitory computer-readable medium (e.g., one or more nonvolatile memory elements, such as EPROM, EEPROM, Flash memory, a hard drive, and so on) that may store at least the following software ("SW") modules:

- A flight path generation and selection SW module 1044 to generate (or enumerate) and select (or determine) flight paths based on information received via the display interface 1012, sensor interface 1014, and/or flight condition interface 1020, wherein the flight path generation and selection SW module 1044 may include an operating system in some embodiments and generate airspace structures in some embodiments, and further include:
  - An airspace model 1045 to model flight paths and/or airspace structures in a multi-dimensional airspace based on information received from display interface 1012, sensor interface 1014, flight condition interface 1020, combinatorial model 1046, and/or satisfiability model 1047;
  - A combinatorial model 1046 to generate one or more flight paths (e.g., candidate flight paths), parameters, path elements, attributes, and/or airspace structures, in the airspace model 1045 based on information received from display interface 1012, sensor interface 1014, and/or flight condition interface 1020; and
  - A satisfiability model 1047 to select one or more flight paths generated by the combinatorial model 1046 based on information received from display interface 1012, sensor interface 1014, and/or flight condition interface 1020.

Each SW module includes instructions that, when executed by processor 1030, cause the airspace planning system 1000 to perform the corresponding functions.

For example, the processor 1030 may execute the flight path generation and selection SW module 1044 to generate and select flight paths based on information received via the display interface 1012, sensor interface 1014, and/or flight condition interface 1020. In executing the flight path generation and selection SW module 1044, the processor 1030 may use the airspace model 1045 to model a multi-dimensional airspace based on information received from display interface 1012, sensor interface 1014, and/or flight condition interface 1020. In some aspects, the processor 1030 may execute the flight path generation and selection SW module 1044 to generate and select flight paths for one or more aircraft in an airspace, such that the one or more aircraft would always be safely separated from one another while traversing their respective flight paths.

The processor 1030 may further execute the combinatorial model 1046 to generate one or more flight paths in the airspace model 1045 based on information received from display interface 1012, sensor interface 1014, and/or flight condition interface 1020. In some embodiments, the processor 1030 may execute the combinatorial model 1046 to generate an airspace structure in the airspace model 1045 based on information received from the display interface 1012, sensor interface 1014, and/or flight condition interface 1020. Further, in some embodiments, the processor 1030 may execute the combinatorial model 1046 to generate one or more flight paths based on the airspace structure, and/or information received from display interface 1012, sensor interface 1014, and/or flight condition interface 1020. In some embodiments, the processor 1030 may execute both the combinatorial model 1046 and the satisfiability model 1047 to generate one or more flight paths in the airspace model 1045, based on the airspace structure and/or information received from display interface 1012, sensor interface 1014, and/or flight condition interface 1020. In some aspects, the airspace structure and/or the one or more generated flight paths may be represented and/or stored as one or more matrices. In some embodiments, the processor 1030 may execute the combinatorial model 1046 to transmit the one or more generated flight paths represented as one or more matrices to the satisfiability model 1047.

The processor 1030 may further execute the satisfiability model 1047 to select one or more of the generated flight paths based on the matrices received from the combinatorial model 1046, and information received from display interface 1012, sensor interface 1014, and/or flight condition interface 1020. In addition, the processor 1030 may execute the satisfiability model 1047 to transmit some or all information concerning the one or more selected flights paths (e.g., the respective parameters, path elements, and/or attributes) to the display interface 1012 for display on a display screen.

Figure 11:
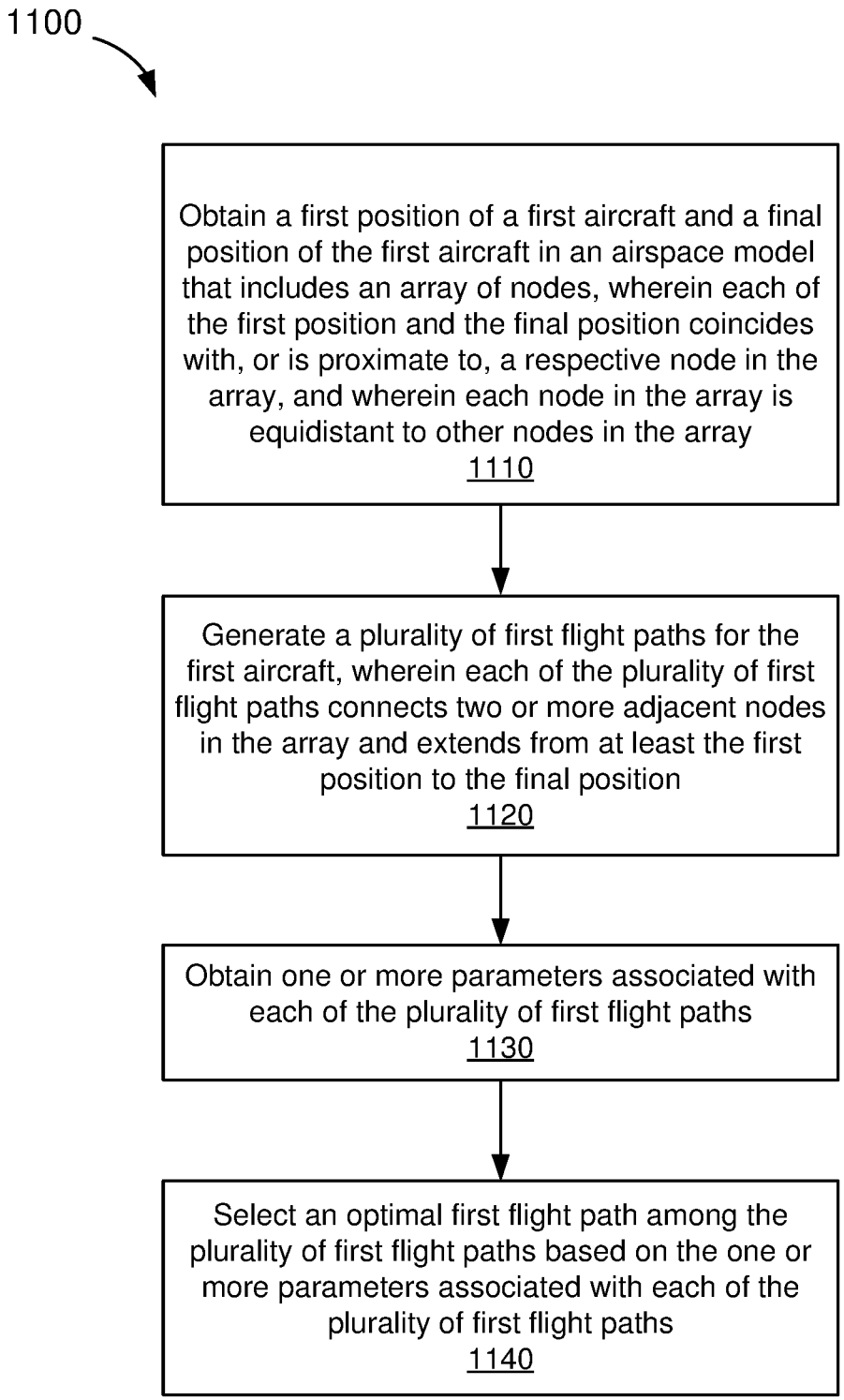
FIG. 11 shows an illustrative flowchart depicting an example method for airspace planning, in accordance with some embodiments.

FIG. 11 shows an illustrative flowchart depicting an example method 1100 for airspace planning, in accordance with some embodiments. With reference to FIG. 10, the operation 1100 may be performed by one or more processors 1030.

The method 1100 may include obtaining first and final positions of an aircraft in an airspace model that includes an array of nodes (1110). Each of the first position and the final position may coincide with, or be proximate to (e.g., be adjacent to or neighbor), a respective node in the array, and each node in the array may be equidistant to other nodes in the array.

The method 1100 may further include generating a plurality of first flight paths for the first aircraft (1120). Each of the plurality of first flight paths may connect two or more adjacent nodes in the array and extend from at least the first position to the final position.

The method 1100 may further include obtaining one or more parameters associated with each of the plurality of first flight paths (1130).

The method 1100 may further include selecting an optimal first flight path among the plurality of first flight paths (1140). The selection may be based on the one or more parameters associated with each of the plurality of first flight paths.

Figure 12A:
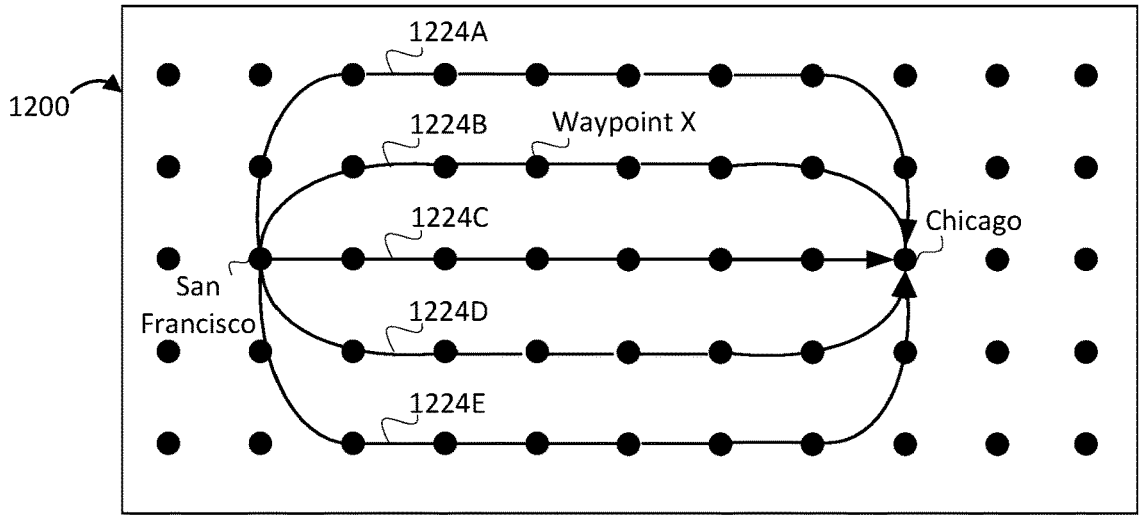
FIGS. 12A-12C show example flight paths in an airspace model, in accordance with some embodiments.
Figure 12B:
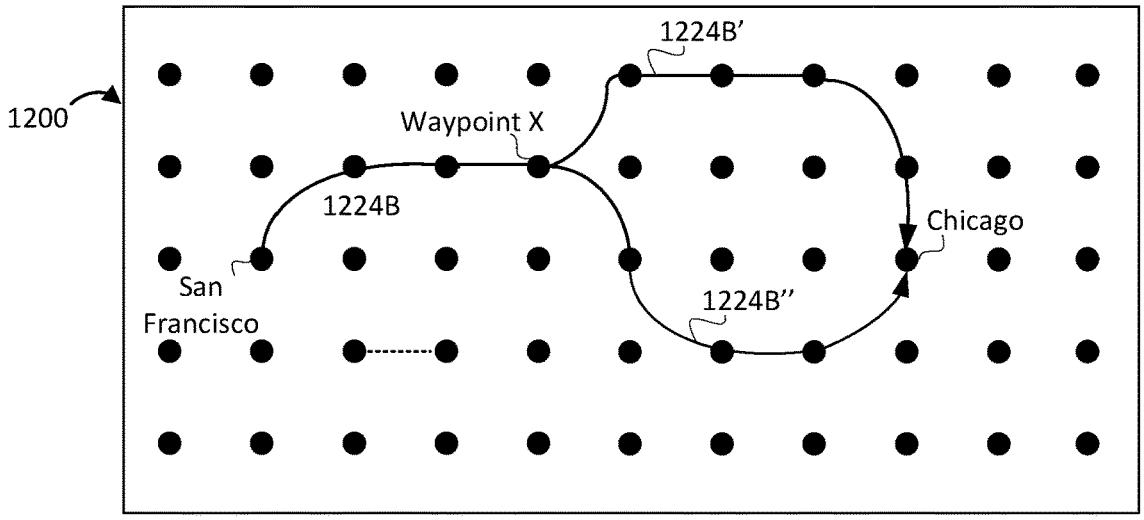
Figure 12C:
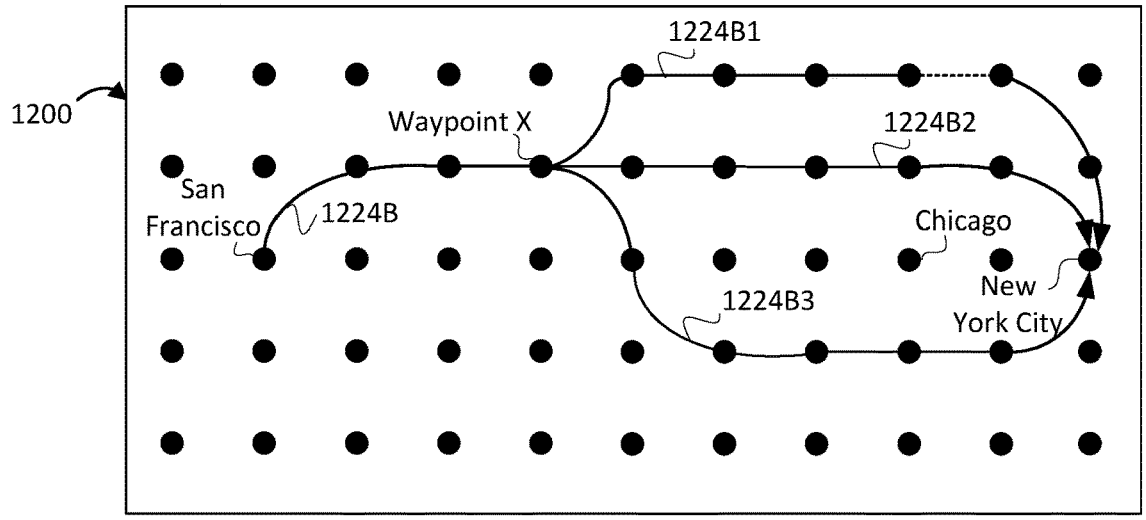

FIGS. 12A-12C show example flight paths 1224 in an airspace model 1200, in accordance with some embodiments. The airspace model 1200 may be an embodiment of airspace model 200, 300, 400, 500, 600, 700, 800, 900, and/or 1045, described above with reference to FIGS. 2A, 2B, 3A-3X, 4A-4H, 5A, 5B, 6A-6D, 7A-7D, and 8-10. The flight paths 1224 may be generated by the flight path generation and selection SW module 1044 of FIG. 10.

For example, a pilot may wish to fly a Boeing 787 from San Francisco to Chicago on a particular day, such that the total time of the flight is minimized. The pilot may also wish to view a flight path of such a flight on a display screen in the cockpit of the Boeing 787. The pilot may input the starting point (San Francisco), ending point (Chicago), particular day, and objective to minimize the total time of flight (collectively, the "flight information") to the display screen using, for example, a graphical user interface (also referred to as a "GUI"). In some embodiments, the GUI may be configured to receive the flight information and to display only a subset of information used and/or generated by the airspace planning system 1000 (e.g., information directly related to the desired flight path). That is, the GUI may be configured to shield the pilot from information used and/or generated by the airspace planning system 1000 that is not closely related to the desired flight path (e.g., information regarding computations and/or undesired flight paths).

With reference to FIG. 10, the display screen may transmit the flight information to the display interface 1012, which then transmits the flight information to the data buffer 1042 for storage. The sensor interface 1014 may then transmit information concerning the Boeing 787 (e.g., flight envelope, health of the aircraft, needed maintenance, amount of fuel on board) to the data buffer 1042 for storage. Further, the flight condition interface 1020 may then transmit information concerning flight conditions (e.g., the flight paths of other aircraft, weather, or restricted airspaces) to the data buffer 1042 for storage. In some aspects, some or all of the information stored in the data buffer 1042 may represent or be associated with one or more constraints and/or optimization conditions to be accounted for during flight (or airspace) planning. For example, the starting point, ending point, particular day, the Boeing 787's flight envelope, and information concerning flight conditions may be represented as constraints in data buffer 1042, and the objective to minimize total time of flight may be represented as an optimization condition in the data buffer 1042.

In some embodiments, the airspace model 1200 may be configured to model an airspace, such as the airspace over the United States and/or other regions in the world. With reference to FIGS. 10 and 12A-12C, the airspace model 1200 may use information stored in the data buffer 1042 to model the airspace in which the Boeing 787 will fly from San Francisco to Chicago.

Further, with reference to FIGS. 10 and 12A, the combinatorial model 1046 may use information stored in data buffer 1042 to generate flight paths 1224A-1224E (and their respective parameters, path elements, and attributes) in the airspace model 1200. In some embodiments, the combinatorial model 1046 may generate flight paths 1224A-1224E based on an airspace structure in the airspace model 1200. One of the parameters associated with each of flight paths 1224A-1224E is the total amount of time required for the Boeing 787 to fly along the respective flight path (i.e., the "total time of flight" parameter). In some embodiments, this parameter may be generated for each flight path by default, or it may be generated because it relates to the optimization condition specified by the pilot and stored in the data buffer 1042. Further, in some aspects, the flight paths 1224A-1224E may represent only some, or all possible flight paths, that satisfy certain constraints stored in data buffer 1042. For example, the flight paths 1224A-1224E may represent all possible flight paths for the Boeing 787 to fly from San Francisco to Chicago on the particular day, given real-time flight conditions.

While only five flight paths are shown in FIG. 12A, in some embodiments, the combinatorial model 1046 may generate hundreds, thousands, or even millions of flight paths that satisfy certain constraints stored in the data buffer 1042. Further, the combinatorial model 1046 may systematically generate (or enumerate) the flight paths 1224A-1224E by applying combinatorial mathematics and graph theory. In some embodiments, the combinatorial model 1046 may use matrices to generate, represent and/or store the flight paths. Further, in some embodiments, one or more of the generated flight paths 1224A-1224E (and optionally any associated parameters, path elements, and/or attributes) may be displayed on the display screen in the cockpit of the Boeing 787 for the pilot to view.

As described above, the pilot wishes to not only fly from San Francisco to Chicago on a particular day, but also to minimize the total time of the flight (an optimization condition). To satisfy the optimization condition, the satisfiability model 1047 may be used to select one or more of flight paths 1224A-1224E that require the least amount of time to fly. Put differently, the satisfiability model 1047 may efficiently search the set of generated flight paths 1224A-1224E to identify the generated flight path for which the value of the total time of flight parameter is minimized. In this example, the flight path 1224B requires the least amount of time to fly due to, for example, forecasted weather or air traffic. Thus, the satisfiability model 1047 may select flight path 1224B. In some embodiments, the satisfiability model 1047 may select more than one optimal flight path (e.g., two flight paths requiring the least amount of time to fly). Further, in some embodiments, the satisfiability model 1047 may be configured to select one or more optimal flight paths based on multiple optimization conditions and constraints stored in data buffer 1042.

Aspects of the present disclosure recognize that the determination of one or more optimal flight paths may represent a satisfiability problem (e.g., a Boolean satisfiability problem and/or non-deterministic polynomial time (NP) problem). In some embodiments, the satisfiability model 1047 may include a solver, or one or more algorithms, written in a constraint-solving programming language such as MiniZinc.

Further, in some embodiments, the satisfiability model 1047 (in conjunction with the processor 1030 and/or other components of the airspace planning system 1000) may use artificial intelligence to optimize and/or smooth generated flight paths. For example, the satisfiability model 1047 may use machine learning techniques, such as gradient descent search, to "polish" generated flight paths. In some embodiments, where the satisfiability model 1047 employs gradient descent search, the satisfiability model 1047 may transform generated flight paths expressed as integers (or in an integer domain) to generated flight paths expressed as real numbers (or in a real number domain). Further, in some embodiments, where the generated flight paths are near global minima, the satisfiability model 1047 may employ gradient descent search to further optimize and/or smooth the generated flight paths and deepen the location of the global minima.

After the satisfiability model 1047 selects flight path 1224B as the optimal flight path, the flight path generation and selection SW module 1044 may transmit flight path 1224B (and optionally any associated parameters, path elements and/or attributes) through the display interface 1012, to the display screen for the pilot to view.

With reference to FIGS. 10 and 12B, the pilot may then depart San Francisco in the Boeing 787 and fly along flight path 1224B. During the flight, the flight path generation and selection SW module 1044 may continually receive flight condition information from flight condition interface 1020. Prior to, or upon reaching waypoint X, the flight path generation and selection SW module 1044 determines that currently (or at some future time), it is (or will no longer be) safe and/or optimal for the Boeing 787 to fly along flight path 1224B based on information received from the flight condition interface 1020. In other words, the flight path generation and selection SW module 1044 may determine that the Boeing 787 needs to be re-routed at waypoint X.

In response to this determination, the combinatorial model 1046 may then generate a new set of flight paths for the Boeing 787, from waypoint X to Chicago, using any of the techniques described above. As shown in FIG. 126, the combinatorial model 1046 may generate flight paths 1224B' and 1224B". The satisfiability model 1047 may then analyze the total time of flight parameter of each of flight paths 1224B' and 1224B" to determine that flight path 1224B' requires the least amount of time to fly. The flight path generation and selection SW module 1044 may then transmit 1224B' to the display interface 1012 for display to the pilot, and/or to the sensor interface 1014.

In some embodiments, the pilot may then re-route the Boeing 787 to flight path 1224B'. In some other embodiments, the pilot may disregard flight path 1224B', and re-route the Boeing 787 to fly along another flight path (e.g., flight path 1224B"). Still further, in some embodiments, the sensor interface 1014 may transmit flight path 1224B', the parameters associated with flight path 1224B' (and optionally the respective path elements and associated attributes) to the Boeing 787's navigation system to automatically re-route the aircraft along flight path 1224B'.

As another example, with reference to FIGS. 10 and 12C, upon reaching waypoint X, the flight path generation and selection SW module 1044 may determine that the pilot now wishes to fly the Boeing 787 to New York instead of Chicago. In response to this determination, the combinatorial model 1044 may generate flight paths 1224B1, 1224B2, and 1224B3 from waypoint X to New York, using any of the techniques described above. The satisfiability model 1047 may then determine that, based on the total time of flight parameter of each of flight paths 1224B1-1224B3, flight path 1224B2 requires the least amount of time to fly and is thus the optimal flight path. The Boeing 787 may then be directed along flight path 1224B2 manually by the pilot, or automatically by the aircraft's navigational system. Accordingly, the airspace planning system 1000 may be used to dynamically generate optimized flight paths in response to changing flight information and/or flight conditions. While the examples described above with reference to FIGS. 12A-12C involve a piloted or manned aircraft, the examples may alternatively involve an un-piloted aircraft or unmanned aircraft (also referred to as an "unmanned aerial vehicle" or "UAV").

Figure 13:
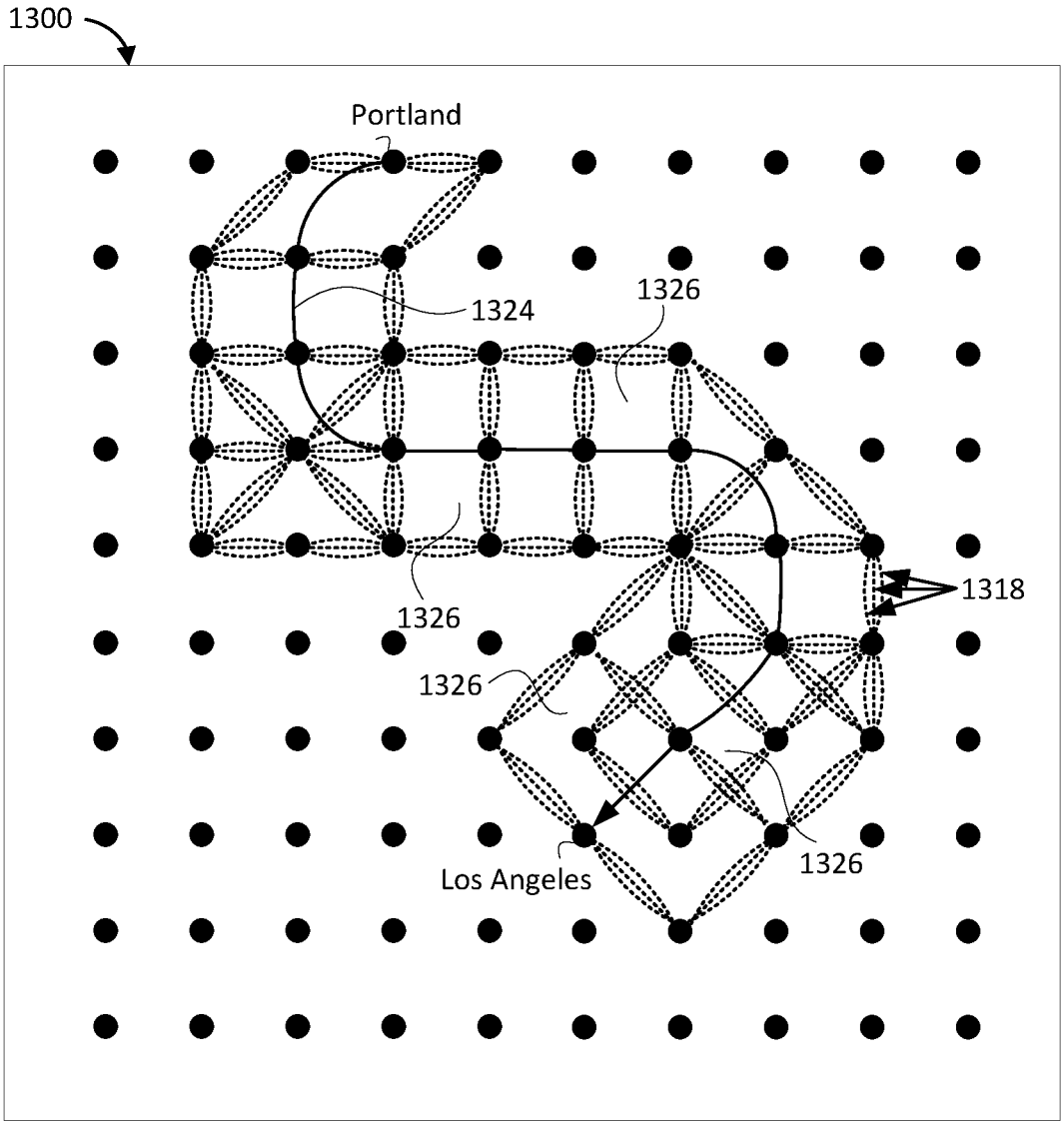
FIG. 13 shows an example exclusive airspace in an airspace model, in accordance with some embodiments.

FIG. 13 shows an example exclusive airspace 1326 in an airspace model 1300, in accordance with some embodiments. The airspace model 1300 may be an embodiment of airspace model 200, 300, 400, 500, 600 700, 800, 900, 1045 and/or 1200, described above with reference to FIGS. 2A, 2B, 3A-3X, 4A-4H, 5A, 5B, 6A-6D, 7A-7D, 8-10, and 12. As shown in FIG. 13, the exclusive airspace 1326 is defined by (or includes) path elements 1318. Further, the exclusive airspace 1326 surrounds flight path 1324, which extends from Portland to Los Angeles. In some embodiments, the exclusive airspace 1326 may be a parameter of flight path 1324. Further, the exclusive airspace 1326 may be used to ensure that an aircraft that flies along flight path 1324 is safely separated from other aircraft. In other words, the exclusive airspace 1326 may represent a region of airspace in which only an aircraft that flies along flight path 1324 is permitted to occupy.

With reference to FIGS. 10 and 13, the flight path generation and selection SW module 1044 may generate path elements 1318, and use path elements 1318 to define the exclusive airspace 1326. In some aspects, each of the path elements 1318 may represent a boundary or region of airspace, and be associated with various attributes, such as one or more of a position, time, time period, cost, and/or aircraft identifier. Such attributes may be used to define not only the boundaries of exclusive airspace 1326, but also the time or time period when all or part of the exclusive airspace 1326 takes effect or is instantiated. Put differently, the exclusive airspace 1326 may represent a region of airspace which, during one or more time periods, is to be exclusively occupied by an aircraft flying along flight path 1324.

In some embodiments, once the airspace planning system 1000 generates flight path 1324 and its associated parameters (including exclusive airspace 1326), the airspace planning system 1000 may transmit flight path 1324 and its associated parameters to other aircraft in the airspace model 1300 to provide those aircraft with notice of flight path 1324 and its associated parameters, including exclusive airspace 1326. Because the airspace planning system 1000 generates flight paths using real-time or near real-time flight condition information, there should not be a conflict (or unsafe distance) between an aircraft that flies along flight path 1324 and other aircraft represented in airspace model 1300. However, if a conflict arises, the airspace planning system 1000 may modify flight path 1324, exclusive airspace 1326, the flight paths of other aircraft, and/or the parameters of flight paths of other aircraft, to ensure that all aircraft represented in airspace model 1300 are safely separated at all times.

Further, in some embodiments, the airspace planning system 1000 may use path elements 1318 not only to define an exclusive airspace that surrounds a flight path, but also to define regions of airspace that are hazardous or subject to certain rules, regulations, or policies.

For example, if the airspace planning system 1000 determines that a particular region of airspace is forecasted to be highly turbulent, the flight path generation and selection SW module 1044 may define the boundaries of a region using one or more of path elements 1318, each with a respective attribute that designates the region as hazardous, and/or closed to all aircraft or restricted to some aircraft. The airspace planning system 1000 may then communicate this information to aircraft represented in the airspace model 1300 so that they may be re-routed, if necessary, to avoid the region.

As another example, if the airspace planning system 1000 determines that a region of airspace is subject to a noise limitation provided in a rule or regulation (e.g., a maximum noise level at nighttime), the flight path generation and selection SW module 1044 may define the region using one or more of path elements 1318, each with a respective attribute that represents the noise limitation and designates the region as restricted or closed. In some embodiments, the noise limitation may be represented by or associated with a cost attribute of each path element 1318. For example, the airspace planning system 1000 may set the value of a cost attribute of a path element 1318 to signal that the region is closed or restricted to certain aircraft. As another example, the cost attribute of a path element 1318 may represent a price that an aircraft operator must pay to enter the region and potentially violate the regulation. Where the cost attribute of the path element 1318 is set to a high value (e.g., hundreds or thousands of dollars), the cost attribute may discourage certain aircraft operators from flying through the region.

It is noted that the shape of exclusive airspace 1326 shown in FIG. 13 is merely an example. Further, one or more of path elements 1318 may be used to define a region of airspace of any shape within the airspace model 1300.

Figure 14:
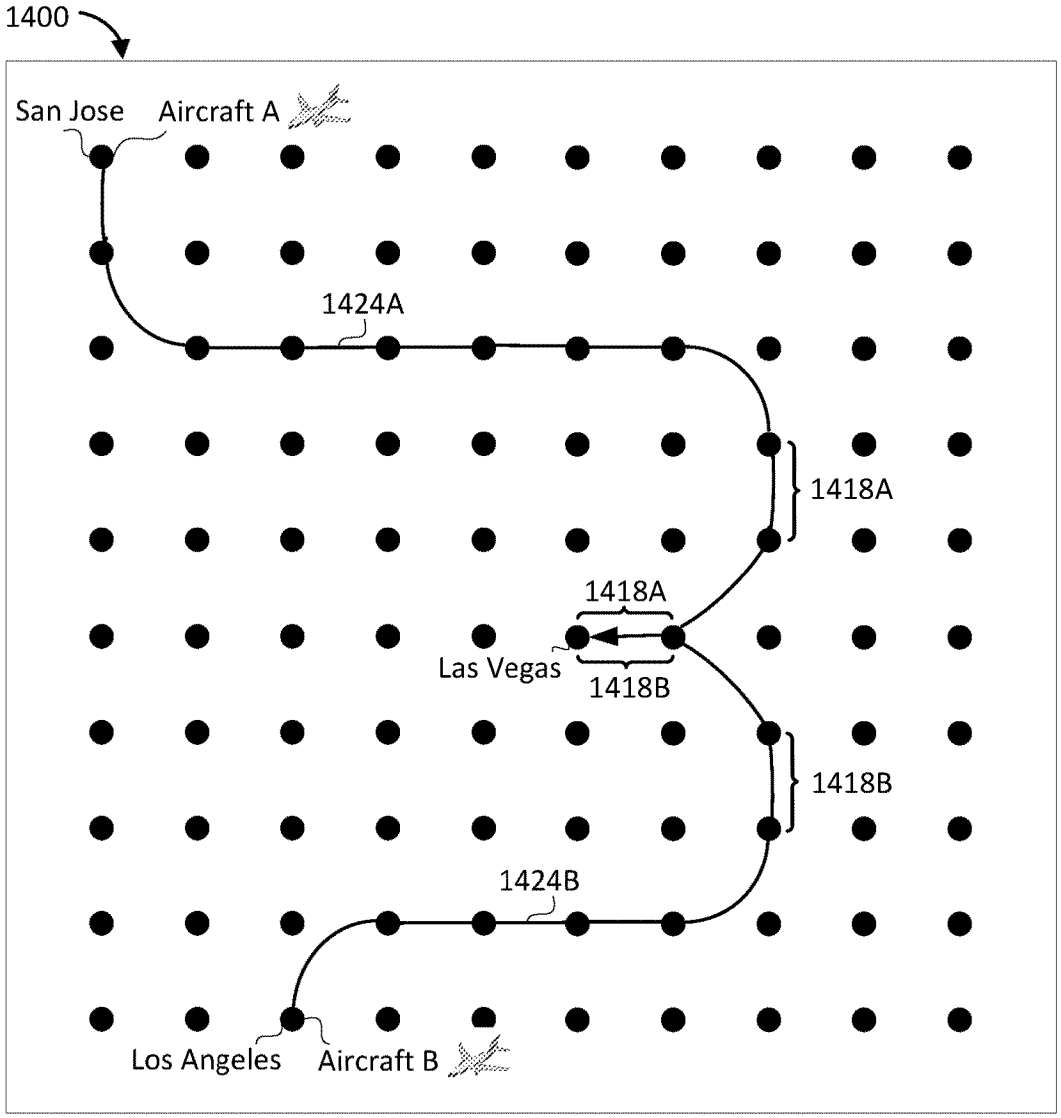
FIG. 14 shows example flight paths for a set of two aircraft in an airspace model, in accordance with some embodiments.

FIG. 14 shows example flight paths for a set (or group) of two aircraft in airspace model 1400, in accordance with some embodiments. The airspace model 1400 may be an embodiment of airspace model 200, 300, 400, 500, 600, 700, 800, 900, 1045, 1200, and/or 1300, described above with reference to FIGS. 2A, 2B, 3A-3X, 4A-4H, 5A, 5B, 6A-6D, 7A-7D, 8-10, 12, and 13. As shown in FIG. 14, the flight path 1424A is associated with aircraft A and extends from San Jose to Las Vegas. The flight path 1424B is associated with aircraft B and extends from Los Angeles to Las Vegas.

With reference to FIGS. 10 and 14, the airspace planning system 1000 may be used to simultaneously generate, and select, flight paths for a set of aircraft including aircraft A and B (and, in some embodiments, tens, hundreds, or thousands of other aircraft) represented in the airspace model 1400. In some aspects, each of flight paths 1424A and 1424B may include a unique set of path elements 1418A and 1418B, respectively. In some aspects, each path element 1418A and 1418B may be associated with various attributes (e.g., position(s), airspeed(s), time(s), or time period(s)), which ensure that aircraft A and B remain safely separated from one another (and other aircraft represented in the airspace model 1400) as aircraft A and B fly along their respective flight paths. Accordingly, while flight paths 1424A and 1424B appear to overlap as they approach Las Vegas, flight paths 1424A and 1424B do not overlap in time due to the unique attributes, such as time(s) and/or time period(s), associated with their respective path elements.

In some embodiments, the airspace planning system 1000 may generate and select flight paths for aircraft A and B periodically, or during a planning cycle that is repeated, for example, every 15 seconds, 30 seconds, or one minute. For example, during a first planning cycle, the flight path generation and selection SW module 1044 may generate and select the flight path 1424A for aircraft A and flight path 1424B for aircraft B using techniques described above. In some embodiments, during any given moment of the first planning cycle, aircraft A may be located at a particular position on a path element 1418A of flight path 1424A, and aircraft B may be located at a particular position on a path element 1418B of flight path 1424B. Further, in some embodiments, the flight path generation and selection SW module 1044 may generate and select the flight path 1424A for aircraft A during the first planning cycle, and flight path 1424B for aircraft B during a second planning cycle, which may occur after the first planning cycle has completed. In some aspects, after a planning cycle has completed, the airspace planning system 1000 may discard the flight paths that were generated but not selected. Further, where a selected flight path is subsequently replanned due to, for example, changing flight conditions, the airspace planning system 1000 may discard the selected flight path.

Figure 15:
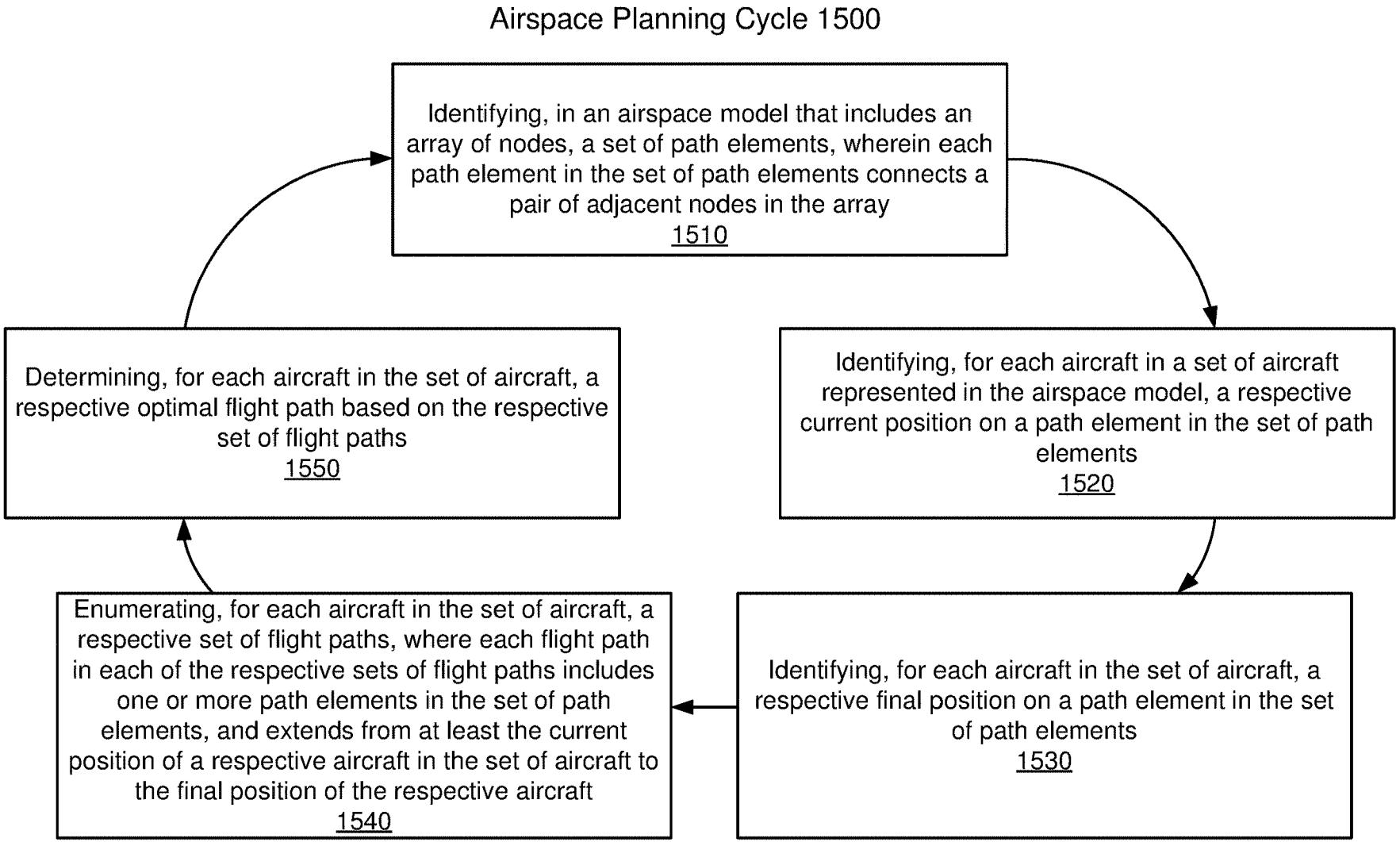
FIG. 15 shows an example airspace planning cycle, in accordance with some embodiments.

FIG. 15 shows an example airspace planning cycle 1500, in accordance with some embodiments. With reference to FIG. 10, the airspace planning cycle 1500 may be performed automatically by one or more processors 1030. In some aspects, the airspace planning cycle 1500 may represent a sequence of operations performed periodically (e.g., every 30 seconds or minute) in order to generate, in real time or near real time, flight paths (or updated flight paths) for multiple aircraft in an airspace.

The operation 1510 may include identifying (or enumerating), in an airspace model that includes an array of nodes, a set of path elements. In some aspects, each path element in the set of path elements may be an embodiment of path element 312 of FIGS. 3A-3X. Further, each path element in the set of path elements may connect a pair of adjacent nodes in the array. In some embodiments, the set of path elements may form an airspace structure (e.g., airspace structure 722 of FIGS. 7B and 7C) or pathways in an airspace structure. Further, in some embodiments, each path element in the set of path elements may be associated with one or more attributes (e.g., attributes 826 of FIG. 8), which may indicate, for example, whether a given path element may be used to form a flight path, or whether the path element represents closed or restricted airspace that may not necessarily be used to form a flight path.

The operation 1520 may include identifying (or obtaining), for each aircraft in a set of aircraft represented in the airspace model, a respective first (or current) position on a path element in the set of path elements. In some embodiments, the set of aircraft may include, for example, tens, hundreds, or thousands of aircraft. Further, in some embodiments, the set of aircraft may include some or all aircraft represented in the airspace model. Additionally, in some embodiments, the first position for each aircraft in the set of aircraft may represent a position on the ground (e.g., on a particular runway) or a position in the air (e.g., aloft), within the airspace model.

The operation 1530 may include identifying (or obtaining), for each aircraft in the set of aircraft, a respective final position (or destination) on a path element in the set of path elements. In some embodiments, the final position for each aircraft in the set of aircraft may represent a position on the ground (e.g., on a particular runway).

The operation 1540 may include generating (or enumerating), for each aircraft in the set of aircraft, a respective set of flight paths (or candidate flight paths), where each flight path in each of the respective sets of flight paths includes one or more path elements in the set of path elements. In some embodiments, the set of flight paths for each aircraft in the set of aircraft may be generated (or enumerated) by a combinatorial model (e.g., the combinatorial model 1046 of FIG. 10). The combinatorial model may include (or be associated with) a matrix of values that represent the set of flight paths for each aircraft in the set of aircraft.

Further, in some embodiments, each flight path in the set of flight paths for a respective aircraft may extend from at least the first position for the respective aircraft to the final position for the respective aircraft. Put differently, each flight path in each of the respective sets of flight paths may extend from at least the current position of a respective aircraft in the set of aircraft to the final position of the respective aircraft. Further, each flight path may be smooth (or seamless) and flyable by the respective aircraft. In some embodiments, the set of flight paths for a respective aircraft may represent all possible flight paths that extend from at least the first position for the respective aircraft to the final position for the respective aircraft. Further, in some embodiments, the sets of flight paths for the set of aircraft may include all enumerated flight paths in the airspace model.

The operation 1550 may include selecting (or determining), for each aircraft in the set of aircraft, a respective optimal flight path based on the respective set of flight paths. In some embodiments, the optimal flight paths may be selected (or determined) simultaneously by a satisfiability model (e.g., the satisfiability model 1047 of FIG. 10 and/or a customized satisfiability solver). Further, in some embodiments, the satisfiability model may use the matrix of values associated with the combinatorial model to select the optimal flight paths. Further, in some embodiments, the selection of a respective optimal flight path for each aircraft may be further based on one or more parameters (e.g., parameters 928 of FIG. 9) associated with each flight path in a respective set of flight paths. Further, in some embodiments, the optimal flight path selected for each respective aircraft may be a flight path that satisfies one or more, or all, constraints and/or optimization conditions associated with an airspace planning system (e.g., airspace planning system 1000 of FIG. 10), and thus may be optimal or near optimal. Put differently, the selected optimal flight paths may represent a set (or ensemble) of flight paths that satisfies one or more, or all, constraints and/or optimization conditions associated with an airspace planning system, and thus may be optimal or near optimal. For example, in some embodiments, each of the selected optimal flight paths may be determined to minimize one or more parameters such as an amount of fuel, a time period, or noise level.

In addition, the optimal flight path selected for each respective aircraft may be a smooth (or seamless) flight path along which the respective aircraft may safely fly. That is, the respective aircraft may safely fly along the optimal flight path because the optimal flight path is configured to be flyable, to safely separate the respective aircraft from other aircraft (e.g., all other aircraft represented in the airspace model), and to shield the respective aircraft from adverse weather conditions represented in the airspace model.

Further, in some embodiments, the optimal flight path selected for each respective aircraft may include a set of navigation instructions. In some embodiments, the set of navigation instructions may be customized or tailored for a respective aircraft. Further, in some embodiments, the navigation instructions may include a position on the optimal flight path to which a respective aircraft should fly by the time the airspace planning cycle 1500 repeats (or at the time the next airspace planning cycle 1500 begins). Further, in some embodiments, the navigation instructions may include one or more parameters associated with a respective optimal flight path. In some embodiments, the navigation instructions may include the path elements forming a respective optimal flight path and one or more attributes (e.g., attributes 826 of FIG. 8) associated with the path elements. Additionally, in some embodiments, the airspace planning cycle 1500 may repeat periodically until at least each aircraft in the set of aircraft arrives at its respective final position.

Those of skill in the art will appreciate that information and signals may be represented using any of a variety of different technologies and techniques. For example, data, instructions, commands, information, signals, bits, symbols, and chips that may be referenced throughout the above description may be represented by voltages, currents, electromagnetic waves, magnetic fields or particles, optical fields or particles, or any combination thereof.

Further, those of skill in the art will appreciate that the various illustrative logical blocks, modules, circuits, and algorithm steps described in connection with the aspects disclosed herein may be implemented as electronic hardware, computer software, or combinations of both. To clearly illustrate this interchangeability of hardware and software, various illustrative components, blocks, modules, circuits, and steps have been described above generally in terms of their functionality. Whether such functionality is implemented as hardware or software depends upon the particular application and design constraints imposed on the overall system. Skilled artisans may implement the described functionality in varying ways for each particular application, but such implementation decisions should not be interpreted as causing a departure from the scope of the disclosure.

The methods, sequences or algorithms described in connection with the aspects disclosed herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An example storage medium is coupled to the processor such that the processor can read information from, and write information to, the storage medium. In the alternative, the storage medium may be integral to the processor.

In the foregoing specification, embodiments have been described with reference to specific examples thereof. It will, however, be evident that various modifications and changes may be made thereto without departing from the broader scope of the disclosure as set forth in the appended claims. The specification and drawings are, accordingly, to be regarded in an illustrative sense rather than a restrictive sense.

What is claimed is:

1. A method for airspace planning performed by one or more processors, comprising:

obtaining a first position of a first aircraft and a final position of the first aircraft in an airspace model that includes an array of nodes arranged as a uniform pattern of triangles, wherein each node of the array of nodes coincides with a vertex or midpoint along an edge of at least one triangle in the uniform pattern of triangles, and wherein each of the first position and the final position coincides with, or is proximate to, a respective node in the array of nodes arranged as the uniform pattern of triangles;

generating a plurality of first flight paths for the first aircraft based on a combinatorial model, wherein each flight path of the plurality of first flight paths connects two or more adjacent nodes in the array of nodes arranged as the uniform pattern of triangles, and wherein each flight path of the plurality of first flight paths extends from at least the first position to the final position;

obtaining one or more parameters associated with each flight path of the plurality of first flight paths;

searching the plurality of first flight paths for an optimal first flight path based on the one or more parameters associated with each flight path of the plurality of first flight paths and a satisfiability model; and communicating the optimal first flight path to the first aircraft, wherein the first aircraft is configured to physically traverse the optimal first flight path.

2. The method of claim 1, wherein the one or more parameters include at least one of a time, a time period, weather conditions, an amount of fuel, a cost, a noise level, a runway direction, a distance between the first position and the final position, and a distance between each flight path of the plurality of first flight paths and a flight path associated with a second aircraft.

3. The method of claim 1, further comprising:

obtaining a second position of the first aircraft in the airspace model;

generating a plurality of second flight paths for the first aircraft based on the combinatorial model, wherein each flight path of the plurality of second flight paths connects two or more adjacent nodes in the array of nodes arranged as the uniform pattern of triangles, and wherein each flight path of the plurality of second flight paths extends from at least the second position to the final position;

obtaining one or more parameters associated with each flight path of the plurality of second flight paths; and searching the plurality of second flight paths for an optimal second flight path based on the one or more parameters associated with each flight path of the plurality of second flight paths and the satisfiability model.

4. The method of claim 1, wherein:

each flight path of the plurality of first flight paths comprises a plurality of path elements; and each path element of the plurality of path elements connects a pair of adjacent nodes in the array of nodes arranged as the uniform pattern of triangles.

5. The method of claim 4, wherein:

the first position of the first aircraft represents a first position on a path element of the plurality of path elements for each flight path of the plurality of first flight paths; and the final position of the first aircraft represents a final position on a path element of the plurality of path elements for each flight path of the plurality of first flight paths.

6. The method of claim 4, wherein at least one path element of the plurality of path elements is curved.

7. The method of claim 4, wherein at least one path element of the plurality of path elements is straight.

8. The method of claim 4, wherein each path element of the plurality of path elements is associated with one or more of a position in the airspace model, a time, a time period, an amount of fuel, a cost, a wind vector, an airspeed, or an aircraft identifier.

9. The method of claim 1, further comprising:

obtaining a second position of a second aircraft and a final position of the second aircraft in the airspace model, wherein each of the second position and the final position of the second aircraft coincides with, or is proximate to, a respective node in the array of nodes arranged as the uniform pattern of triangles;

generating a plurality of second flight paths for the second aircraft based on the combinatorial model, wherein each flight path of the plurality of second flight paths connects two or more adjacent nodes in the array of nodes arranged as the uniform pattern of triangles, and wherein each flight path of the plurality of second flight paths extends from at least the second position to the final position of the second aircraft;

obtaining one or more parameters associated with each flight path of the plurality of second flight paths; and searching the plurality of second flight paths for an optimal second flight path based on the one or more parameters associated with each flight path of the plurality of second flight paths and the satisfiability model.

10. A system for airspace planning, comprising:

at least one processor; and at least one memory storing instructions that, when executed by the at least one processor, cause the system to:

obtain a first position of a first aircraft and a final position of the first aircraft in an airspace model that includes an array of nodes arranged as a uniform pattern of triangles, wherein each node of the array of nodes coincides with a vertex or midpoint along an edge of at least one triangle in the uniform pattern of triangles, and wherein each of the first position and the final position coincides with, or is proximate to, a respective node in the array of nodes arranged as the uniform pattern of triangles;

generate a plurality of first flight paths for the first aircraft based on a combinatorial model, wherein each flight path of the plurality of first flight paths connects two or more adjacent nodes in the array of nodes arranged as the uniform pattern of triangles, and wherein each flight path of the plurality of first flight paths extends from at least the first position to the final position;

obtain one or more parameters associated with each flight path of the plurality of first flight paths;

search the plurality of first flight paths for an optimal first flight path based on the one or more parameters associated with each flight path of the plurality of first flight paths and a satisfiability model; and communicate the optimal first flight path to the first aircraft, wherein the first aircraft is configured to physically traverse the optimal first flight path.

11. The system of claim 10, wherein the one or more parameters include at least one of a time, a time period, weather conditions, an amount of fuel, a cost, a noise level, a runway direction, a distance between the first position and the final position, and a distance between each flight path of the plurality of first flight paths and a flight path associated with a second aircraft.

12. The system of claim 10, wherein execution of the instructions further causes the system to:

obtain a second position of the first aircraft in the airspace model;

generate a plurality of second flight paths for the first aircraft based on the combinatorial model, wherein each flight path of the plurality of second flight paths connects two or more adjacent nodes in the array of nodes arranged as the uniform pattern of triangles, and wherein each flight path of the plurality of second flight paths extends from at least the second position to the final position;

obtain one or more parameters associated with each flight path of the plurality of second flight paths; and search the plurality of second flight paths for an optimal second flight path based on the one or more parameters associated with each flight path of the plurality of second flight paths and the satisfiability model.

13. The system of claim 10, wherein:

each flight path of the plurality of first flight paths comprises a plurality of path elements; and each path element of the plurality of path elements connects a pair of adjacent nodes in the array of nodes arranged as the uniform pattern of triangles.

14. The system of claim 13, wherein:

the first position of the first aircraft represents a first position on a path element of the plurality of path elements for each flight path of the plurality of first flight paths; and the final position of the first aircraft represents a final position on a path element of the plurality of path elements for each flight path of the plurality of first flight paths.

15. The system of claim 13, wherein at least one path element of the plurality of path elements is curved.

16. The system of claim 13, wherein at least one path element of the plurality of path elements is straight.

17. The system of claim 13, wherein each path element of the plurality of path elements is associated with one or more of a position in the airspace model, a time, a time period, an amount of fuel, a cost, a wind vector, an airspeed, or an aircraft identifier.

18. The system of claim 10, wherein execution of the instructions further causes the system to:

obtain a second position of a second aircraft and a final position of the second aircraft in the airspace model, wherein each of the second position and the final position of the second aircraft coincides with, or is proximate to, a respective node in the array of nodes arranged as the uniform pattern of triangles;

generate a plurality of second flight paths for the second aircraft based on the combinatorial model, wherein each flight path of the plurality of second flight paths connects two or more adjacent nodes in the array of nodes arranged as the uniform pattern of triangles, and wherein each flight path of the plurality of second flight paths extends from at least the second position to the final position of the second aircraft;

obtain one or more parameters associated with each flight path of the plurality of second flight paths; and search the plurality of second flight paths for an optimal second flight path based on the one or more parameters associated with each flight path of the plurality of second flight paths and the satisfiability model.

19. A system for airspace planning, comprising:

at least one processor; and at least one memory storing instructions that, when executed by the at least one processor, cause the system to:

generate, in an airspace model that includes an array of nodes arranged as a uniform pattern of triangles, a plurality of pathways based on a combinatorial model, wherein each node of the array of nodes coincides with a vertex or midpoint along an edge of at least one triangle in the uniform pattern of triangles, wherein each pathway of the plurality of pathways comprises one or more path elements, and wherein each path element of the one or more path elements connects a pair of adjacent nodes in the array of nodes arranged as the uniform pattern of triangles;

obtain a first position of a first aircraft and a final position of the first aircraft in the airspace model, wherein each of the first position and the final position coincides with, or is proximate to, a respective node in the array of nodes arranged as the uniform pattern of triangles;

generate a plurality of first flight paths for the first aircraft based on the plurality of pathways and the combinatorial model, wherein each flight path of the plurality of first flight paths extends from at least the first position to the final position;

obtain one or more parameters associated with each flight path of the plurality of first flight paths;

search the plurality of first flight paths for an optimal first flight path based on the one or more parameters associated with each flight path of the plurality of first flight paths and a satisfiability model; and communicate the optimal first flight path to the first aircraft, wherein the first aircraft is configured to physically traverse the optimal first flight path.

20. The system of claim 19, wherein execution of the instructions further causes the system to:

obtain a second position of a second aircraft and a final position of the second aircraft in the airspace model, wherein each of the second position and the final position of the second aircraft coincides with, or is proximate to, a respective node in the array of nodes arranged as the uniform pattern of triangles;

generate a plurality of second flight paths for the second aircraft based on the plurality of pathways and the combinatorial model, wherein each flight path of the plurality of second flight paths extends from at least the second position to the final position of the second aircraft;

obtain one or more parameters associated with each flight path of the plurality of second flight paths; and search the plurality of second flight paths for an optimal second flight path based on the one or more parameters associated with each flight path of the plurality of second flight paths and the satisfiability model.

21. A method for airspace planning performed by one or more processors comprising:

identifying, in an airspace model that includes an array of nodes arranged as a uniform pattern of triangles, a plurality of path elements, wherein each node of the array of nodes coincides with a vertex or midpoint along an edge of at least one triangle in the uniform pattern of triangles, and wherein each path element of the plurality of path elements connects a pair of adjacent nodes in the array of nodes arranged as the uniform pattern of triangles;

obtaining, for each aircraft of a plurality of aircraft represented in the airspace model, a respective current position on a path element of the plurality of path elements;

obtaining, for each aircraft of the plurality of aircraft, a respective final position on a path element of the plurality of path elements;

enumerating, for each aircraft of the plurality of aircraft, a respective plurality of flight paths based on a combinatorial model, wherein each flight path of each of the respective pluralities of flight paths includes one or more path elements of the plurality of path elements, and extends from at least the current position of a respective aircraft of the plurality of aircraft to the final position of the respective aircraft;

obtaining one or more parameters associated with each flight path of each of the respective pluralities of flight paths;

searching the respective pluralities of flight paths for a respective optimal flight path for each aircraft of the plurality of aircraft based on the one or more parameters associated with each flight path of each of the respective pluralities of flight paths and a satisfiability model; and communicating to each respective aircraft of the plurality of aircraft, the respective optimal flight path, wherein each respective aircraft of the plurality of aircraft is configured to physically traverse the respective optimal flight path.

22. The method of claim 21, wherein the respective pluralities of flight paths comprise all enumerated flight paths in the airspace model, and wherein each flight path of the respective pluralities of flight paths is flyable by a respective aircraft of the plurality of aircraft.

23. The method of claim 21, wherein the respective pluralities of flight paths are represented by a matrix associated with the combinatorial model, and the respective optimal flight path for each respective aircraft of the plurality of aircraft is searched for based on the matrix.

24. The method of claim 21, wherein the method is performed periodically.

25. The method of claim 24, wherein the method is performed automatically in real time.

26. The method of claim 21, wherein the plurality of aircraft represented in the airspace model comprises all aircraft represented in the airspace model.

27. The method of claim 21, wherein the respective optimal flight path for each aircraft of the plurality of aircraft comprises a continuous flight path along which a respective aircraft of the plurality of aircraft may fly and be separated from all other aircraft of the plurality of aircraft.

28. The method of claim 21, wherein the respective optimal flight path for each aircraft of the plurality of aircraft comprises a plurality of navigation instructions.

29. The method of claim 21, wherein the one or more parameters include at least one of a time, a time period, weather conditions, an amount of fuel, a cost, a noise level, a runway direction, and a distance between the current position of a respective aircraft of the plurality of aircraft and the final position of the respective aircraft of the plurality of aircraft.

30. The method of claim 29, wherein searching for the respective optimal flight path for each aircraft of the plurality of aircraft includes minimizing at least one of the one or more parameters.

31. The method of claim 21, wherein at least one path element of the plurality of path elements is curved.

32. The method of claim 21, wherein at least one path element of the plurality of path elements is straight.

33. The method of claim 21, wherein each path element of the plurality of path elements is associated with one or more of a position in the airspace model, a time, a time period, an amount of fuel, a cost, a wind vector, an airspeed, or an aircraft identifier.

* * * * *